United States Patent [19]

Okuyama et al.

[11] 4,240,316

[45] Dec. 23, 1980

[54] KEYBOARD TYPE ELECTRONIC MUSICAL INSTRUMENT

[75] Inventors: Yasuhiko Okuyama; Koji Tanaka, both of Ora; Yoshiro Nakayama, Kumagaya; Hiroshi Kato, Ageo, all of Japan

[73] Assignee: Kabushiki Kaisha Kawai Gakki Seisakusho, Hamamatsu, Japan

[21] Appl. No.: 914,684

[22] Filed: Jun. 12, 1978

[30] Foreign Application Priority Data

| | | | |
|---|---|---|---|
| Jun. 17, 1977 | [JP] | Japan | 52-71682 |
| Jun. 17, 1977 | [JP] | Japan | 52-71683 |
| Sep. 9, 1977 | [JP] | Japan | 52-107980 |
| Sep. 22, 1977 | [JP] | Japan | 52-114145 |
| Nov. 7, 1977 | [JP] | Japan | 52-133345 |
| Nov. 10, 1977 | [JP] | Japan | 52-135117 |

[51] Int. Cl.[3] ..... G10H 1/38; G10H 5/00

[52] U.S. Cl. ..... 84/1.01; 84/1.03; 84/DIG. 22

[58] Field of Search ..... 84/1.01, 1.03, DIG. 2, 84/DIG. 22, 1.17

[56] References Cited

U.S. PATENT DOCUMENTS

| | | | |
|---|---|---|---|
| 3,610,799 | 10/1971 | Watson | 84/1.01 |
| 3,875,842 | 4/1975 | Kmetz | 84/1.01 |
| 3,882,751 | 5/1975 | Tomisawa | 84/1.01 |
| 3,951,028 | 4/1976 | Robinson | 84/1.03 |
| 4,011,784 | 3/1977 | Fukui | 84/1.01 |
| 4,022,098 | 5/1977 | Deutsch | 84/1.03 |
| 4,046,047 | 9/1977 | Roberts | 84/1.03 |
| 4,072,078 | 2/1978 | Shallenberger | 84/1.03 |
| 4,074,233 | 2/1978 | Swain | 84/1.01 |
| 4,141,268 | 2/1979 | Kugisawa | 84/1.01 |
| 4,142,433 | 3/1979 | Gross | 84/1.01 |

*Primary Examiner*—S. J. Witkowski

*Attorney, Agent, or Firm*—Fleit & Jacobson

[57] ABSTRACT

A keyboard type electronic musical instrument wherein tone assignment signals (key depression signals) designated by depressing desired keys of keyboards are transmitted to an electronic circuit block through only one signal line per sort of keyboard as time-divided serial timing signals. The electronic circuit block includes therein a circuit which generates parallel output signals having respectively different timings in correspondence with notes of the keyboards. The parallel timing signals are respectively sent to the corresponding key switches of the keyboards, they are selected by turning "on" the switches, and they are converted by OR circuits into serial timing signals representative of the selected notes. The serial timing signals are sent to a device for detecting and storing notes or chords, whereupon as in prior arts, a tone signal is generated from the obtained signal indicative of a note or chord by tone signal producing device and it is amplified and provided as an output by a loudspeaker. This time-division control system is applicable to electronic musical instruments having any desired forms of keyboards.

13 Claims, 27 Drawing Figures

D KEY DEPRESSION

KEYBOARD TYPE ELECTRONIC MUSICAL INSTRUMENT

BACKGROUND OF THE INVENTION

This invention relates to a keyboard type electronic musical instrument which is controlled by time division. More particularly, it relates to an electronic musical instrument in which parallel signals of timings corresponding to respective notes of a keyboard are generated and transmitted to respective key switch circuits of the keyboard and in which a sum of note assignment signals (key depression signals) designated by key depression operations is taken by an OR circuit so as to transmit the signals to note or chord detection means in the form of serial timing signals.

An electronic musical instrument provided with a keyboard generates musical sounds in such a way that signals produced by depressing keys are processed in an electronic circuit. There are also electronic musical instruments which can, not only play the melody, but also generate chords or bass tones by operating an accompanying keyboard or a pedal keyboard. In recent years, there have also been developed electronic musical instruments in which a chord and a bass tone are automatically played in rhythmic accompaniment merely by depressing a single key on an accompanying keyboard or in which an automatic accompaniment is effected by a chord played on an accompanying keyboard and a bass tone adequate thereto. In such electronic musical instruments, as functions to be possessed become greater in diversity and higher in degree, circuit arrangements naturally become more complicated. In order to enhance the reliability and maintainability of apparatus and to achieve the reduction of cost, it is indispensable to put principal circuit blocks into the form of an LSI. In general, the cost of an LSI is dependent upon the price of a package, in other words, the number of pins at the time of mass production. Therefore, the circuit system of the electronic musical instruments needs to be suitable for the form of the LSI.

In the prior-art electronic musical instruments, the keyboard portion and the electronic circuit side are connected by signal lines corresponding to the respective notes of the keyboard so that key depression signals (tone assignment signals) may be entered onto the electronic circuit side in parallel. For this reason, the same number of signal lines as the number of the notes are required every sort of keyboard. That is, the keyboard portion and the electronic circuit side must be interconnected by signal lines in a number which corresponds to the product between the number of the sorts of the keyboards and the number of the notes. This makes the number of input terminals on the electronic circuit side very large, and the fabrication in the form of an LSI difficult.

SUMMARY OF THE INVENTION

It is therefore an object of this invention to provide an electronic musical instrument which has a circuit arrangement adapted to minimize the number of signal lines from a keyboard portion to an electronic circuit side and to be put into large-scale integration.

Another object of this invention is to provide an electronic musical instrument in which key depression signals are entered onto an electronic circuit side as serial signals differing in timing in correspondence with respective notes, under a time-division control.

Still another object of this invention is to provide an electronic musical instrument in which a response characteristic at key depression is improved, and even when a pulsative noise is induced at an input terminal on an electronic circuit side, the probability of a malfunction due to the induced noise can be conspicuously lowered.

A further object of this invention is to provide an electronic musical instrument in which, when a plurality of pedals are concurrently actuated, either the lowest note or the highest note among the actuated pedals can be preferentially detected by a simple circuit.

A further object of this invention is to provide an electronic musical instrument in which discrete key-depression pulse signals are converted into a continuous d.c. signal indicative of a key depression state, thereby making it possible to execute smooth performance of a musical sound.

A yet further object of this invention is to provide an electronic musical instrument which is equipped with a plurality of sorts of keyboards and which has a variety of automatic accompanying functions to players' liking.

Briefly, according to the present invention there is provided a keyboard type electronic musical instrument comprising a note signal generator which generates binary information corresponding to respective notes of a keyboard sequentially and cyclically by utilizing timing pulses of a fixed frequency, a converter circuit which sequentially decodes said binary information to form parallel signals of respectively different timings and which supplies the timing signals to respectively corresponding key switches of said keyboard, a key switch circuit which, upon depression of a key of said keyboard, actuates only the switch of the particular key to deliver the same signal as the entering timing signal, an OR circuit which takes a sum of all the timing signals into key depression signals of time-divided serial timing and which transmits them by one signal line per sort of keyboard, note or chord detection and storage device for detecting and storing the note or chord assigned by the key depression signal of the serial timing, tone signal production device for producing a tone signal from the obtained signal indicative of said note or chord, and output device for amplifying said tone signal and driving a loudspeaker.

Other objects and features of the present invention will become apparent from the detailed description of preferred embodiments thereof, which will be read with the accompanying drawings.

DESCRIPTION OF THE PREFERRED EMBODIMENT

The invention is widely applicable to electronic musical instruments having keyboards. It is most effective when applied to an automatic accompanying equipment which is provided with a plurality of sorts of keyboards and with which various automatic accompaniments can be played upon occasion as a performer likes. Such an equipment will therefore be described hereunder.

I. Outline of Automatic Accompanying Equipment

Figure 1:
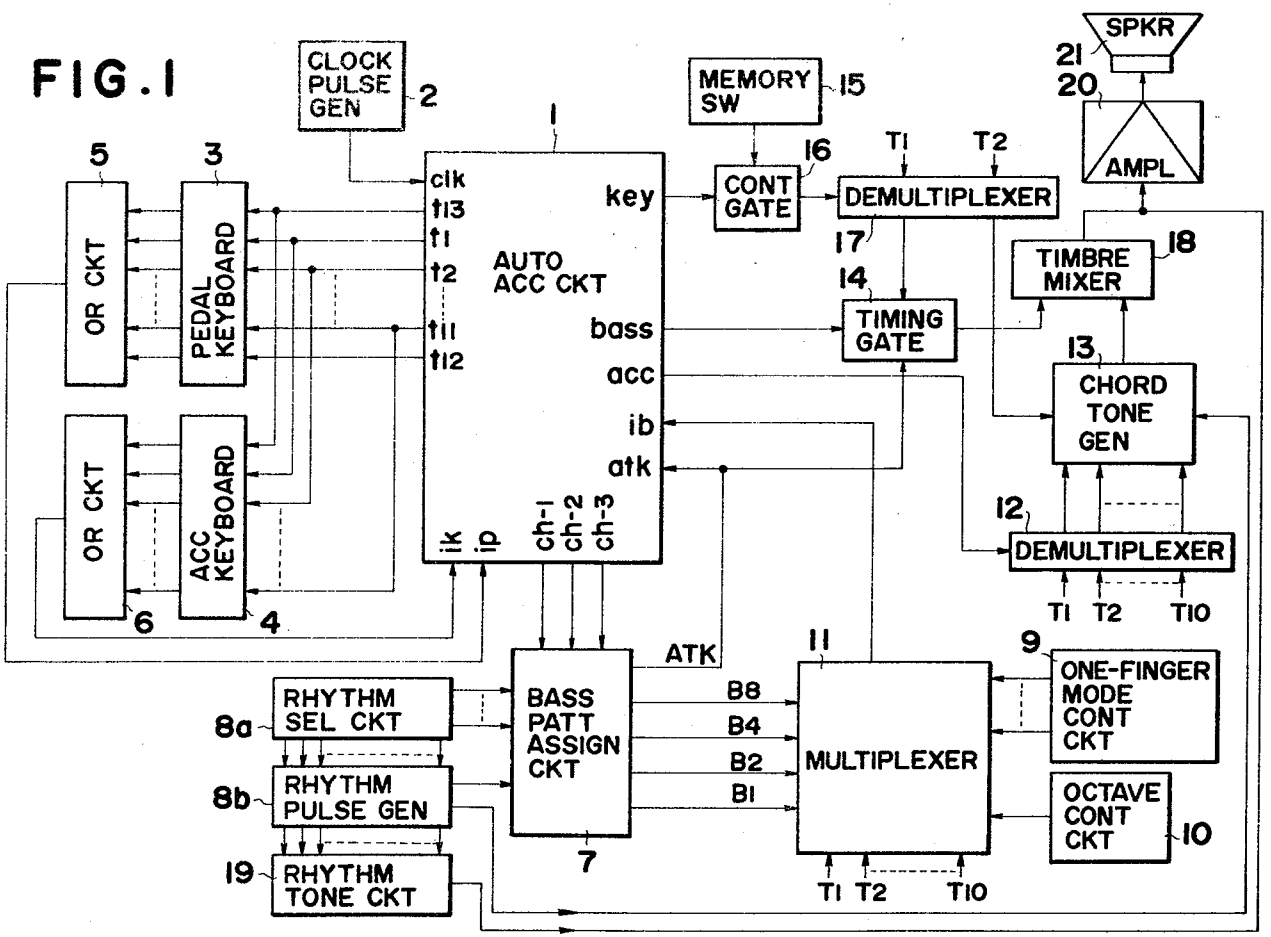
FIG. 1 is a block diagram which shows a preferred embodiemnt of an automatic accompanying equipment according to this invention.
Figure 2:
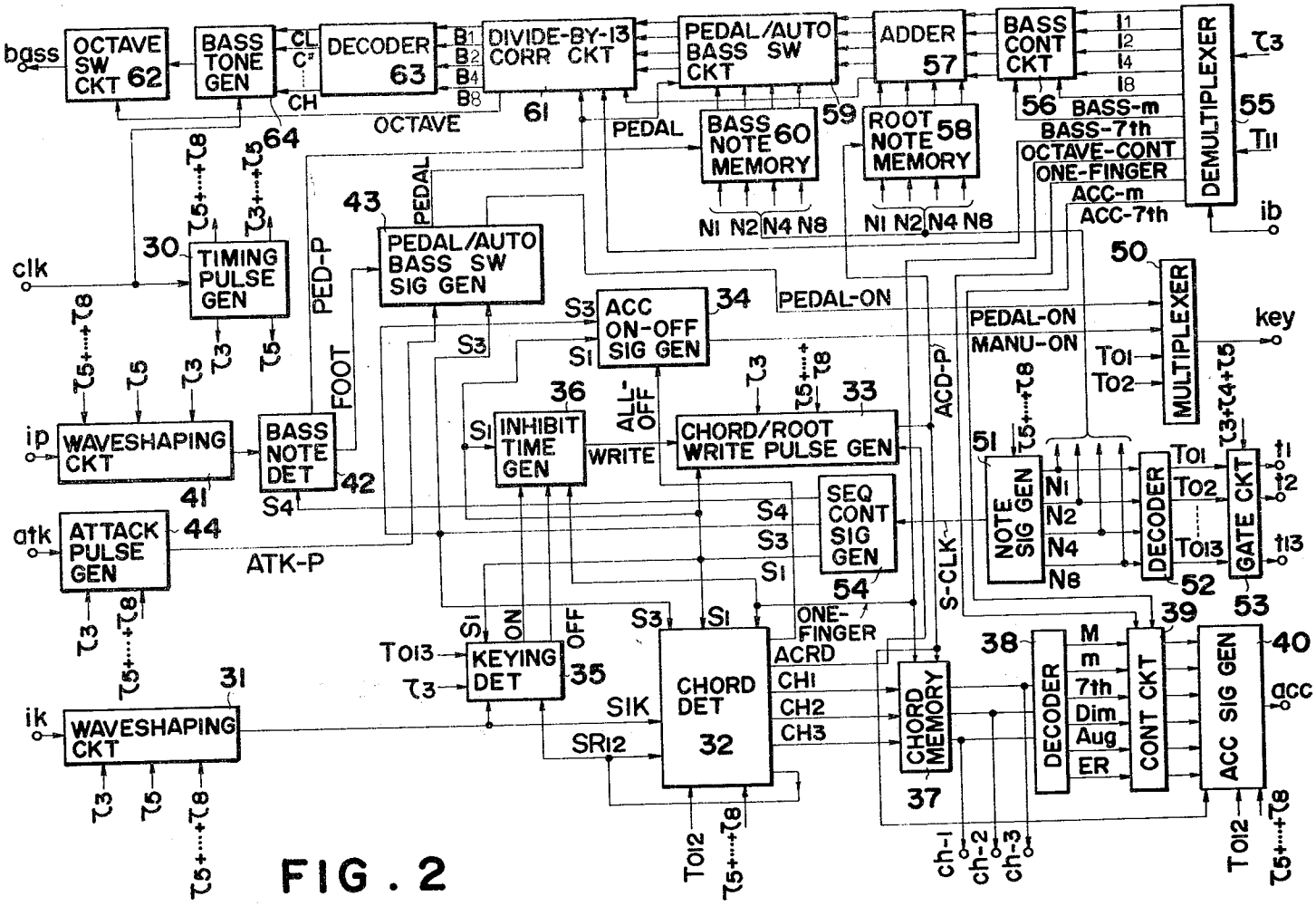
FIG. 2 shows a block diagram of an automatic accompanying circuit in the equipment of FIG. 1.
Figure 3:
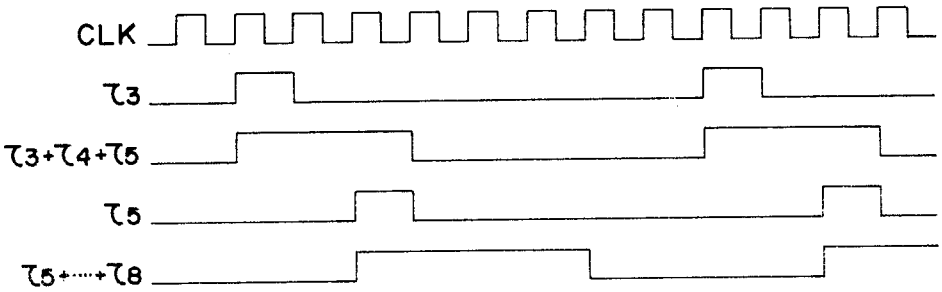
FIG. 3 is a timing diagram which shows output signals of a clock pulse and timing pulse generator circuit.
Figure 4:
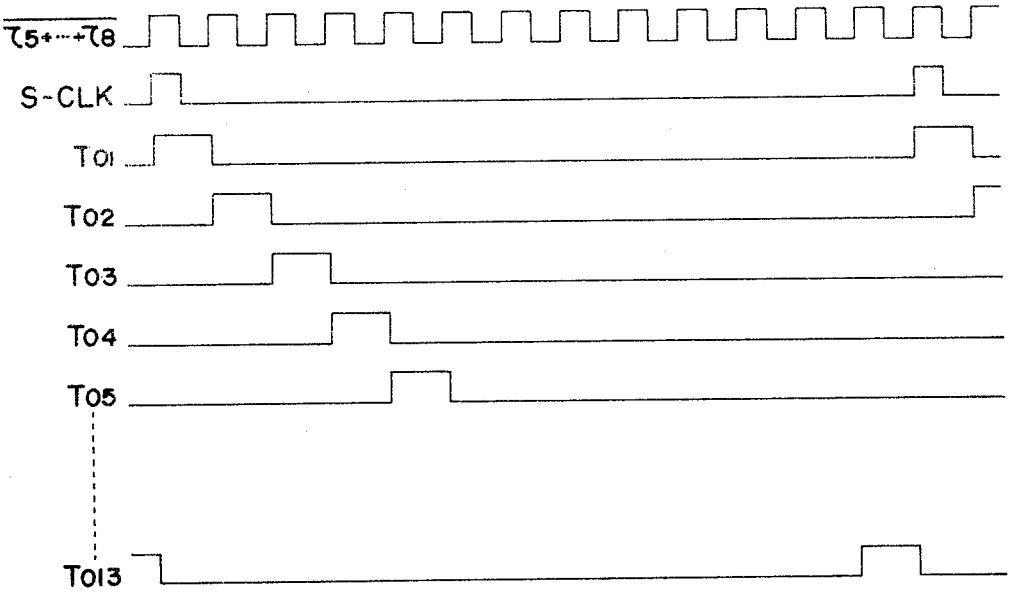
FIG. 4 is a timing diagram which shows output signals of a decoder for decoding binary information representative of notes, together with parts of input and output signals of a note signal generator.
Figure 5:
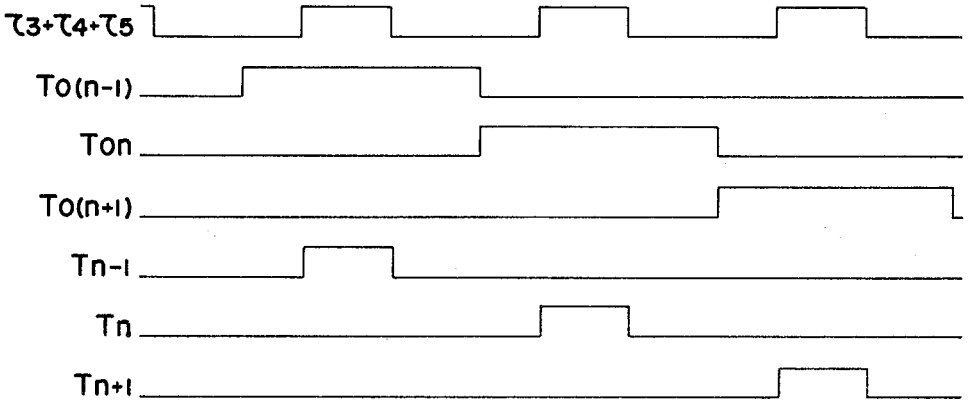
FIG. 5 is a timing diagram of input and output signals of a gate circuit for waveshaping the output of the decoder.

In order to facilitate understanding, the schematic construction of the automatic accompanying equipment and the operation thereof will be explained. As shown in FIG. 1, the automatic accompanying equipment is constructed in such a manner that keyboard portions, peripheral circuits etc. are connected around and to an automatic accompanying circuit 1 which is put into the form of a perfect LSI (large-scale integrated circuit). The automatic accompanying circuit 1 is as illustrated in FIG. 2, and will be stated in detail later. A clock pulse generator 2 generates clock pulses CLK at a fixed frequency (refer to FIG. 3), and supplies them to the automatic accompanying circuit 1. By utilizing the clock pulses CLK the automatic accompanying circuit 1 carries out various signal processings and makes thirteen sorts of parallel signals $T_1, T_2, \ldots, T_{13}$ different in timing from one another (refer to FIGS. 4 and 5), which are respectively delivered from output terminals $t_1, t_2, \ldots, t_{13}$. Such parallel timing signals $T_1, T_2, \ldots, T_{13}$ are respectively supplied to a pedal keyboard 3 as well as an accompanying keyboard 4, provided that the output terminal $t_{12}$ is connected with the pedal keyboard 3 but not with the accompanying keyboard 4.

The pedal keyboard 3 has switches which are turned "on" and "off" by thirteen pedals for designating or assigning bass notes. The notes of the pedals are allotted to the timing signals as indicated in Table 1.

TABLE 1

| Note | $C_L$ | C# | D | D# | E | F | F# | G | G# | A | A# | B | $C_H$ |
|---|---|---|---|---|---|---|---|---|---|---|---|---|---|
| Timing signal | $T_{13}$ | $T_1$ | $T_2$ | $T_3$ | $T_4$ | $T_5$ | $T_6$ | $T_7$ | $T_8$ | $T_9$ | $T_{10}$ | $T_{11}$ | $T_{12}$ |

The accompanying keyboard 4 has switches which are turned "on" and "off" by accompanying keys for designating or assigning chords for automatic accompaniment. The notes of the accompanying keys are allotted to the timing signals as in Table 2.

TABLE 2

| Notes | C | C# | D | D# | E | F | F# | G | G# | A | A# | B |
|---|---|---|---|---|---|---|---|---|---|---|---|---|
| Timing signal | $T_{13}$ | $T_1$ | $T_2$ | $T_3$ | $T_4$ | $T_5$ | $T_6$ | $T_7$ | $T_8$ | $T_9$ | $T_{10}$ | $T_{11}$ |

The timing signals $T_1, T_2, \ldots$ designated by the pedal keyboard 3 or the accompanying keyboard 4 are put together into a single signal line by an OR circuit 5 or 6 and are led to a terminal ip or ik of the automatic accompanying circuit 1, respectively. The chord detection results of the accompanying key-assigned signals $I_K$ having entered the terminal ik are obtained from terminals ch-1, ch-2 and ch-3 in the form of binary signals (chord type-designating signals) as indicated in Table 3-1. An example of the allotment of chord types of the accompanying key-designated signals $I_K$ in the case of the C chord is given in Table 3-2.

TABLE 3-1

| Chord | Output LSB ch-1 | ch-2 | MSB ch-3 |
|---|---|---|---|
| major (M) | 0 | 0 | 0 |
| minor (m) | 1 | 0 | 0 |
| seventh (7th) | 0 | 1 | 0 |
| augment (Aug) | 1 | 1 | 0 |
| diminish (Dim) | 0 | 1 | 1 |

TABLE 3-1-continued

| Chord | Output LSB ch-1 | ch-2 | MSB ch-3 |
|---|---|---|---|
| erroneous key depression (ER) | 1 | 1 | 1 |

TABLE 3-2

| Chord | Accompanying key C | C# | D | D# | E | F | F# | G | G# | A | A# | B |
|---|---|---|---|---|---|---|---|---|---|---|---|---|
| major (M) | 1 | | | | | | | | | | | |
| | 1 | | | | 1 | | | | | | | |
| | 1 | | | | | | | 1 | | | | |
| | 1 | | | | 1 | | | 1 | | | | |
| | 1 | | | | 1 | | | 1 | | 1 | | |
| | 1 | | | | 1 | | | 1 | | | | 1 |
| minor (m) | 1 | | | 1 | | | | | | | | |
| | 1 | | | 1 | | | | 1 | | | | |
| | 1 | | | 1 | | | | | | | 1 | |
| | 1 | | | 1 | | | | 1 | | 1 | | |
| | 1 | | | 1 | | | | 1 | | | | 1 |
| seventh (7th) | 1 | | | | 1 | | | | | | 1 | |
| | 1 | | | | 1 | | | 1 | | | 1 | |
| augment (Aug) | 1 | | | | 1 | | | | 1 | | | |
| diminish (Dim) | 1 | | | 1 | | | 1 | | | | | |
| | 1 | | | 1 | | | 1 | | | 1 | | |

Here, symbol "1" denotes a depressed key state, and blank a released key state. Any accompanying key-designated signal $I_K$ other than those in Table 3-2 corresponds to the erroneous key depression ER.

The chord type-assigning signal is supplied to a bass pattern assignment circuit 7 along with a rhythm assigning signal generated by a rhythm selector 8*a*. Thus, stored information which correspond to the kind of rhythm (such as waltz and rhumba) and the type of chord (such as major and minor) are selected. The stored information, i.e., 4-bit binary degree signal for assigning a bass pattern for automatic bass accompaniment is read out in accordance with timing signals generated from a rhythm pulse generator 8*b*. An example is given in Table 4.

TABLE 4

| Chord assignment | Stored signal $B_8$ | $B_4$ | $B_2$ | $B_1$ | Degree |
|---|---|---|---|---|---|
| | MSB | | | LSB | |
| | 0 | 0 | 0 | 0 | prime |
| | 0 | 1 | 0 | 0 | major third |
| | 0 | 1 | 1 | 1 | perfect fifth |
| major | 1 | 0 | 0 | 1 | major sixth |
| | 1 | 0 | 1 | 0 | minor seventh |
| | 1 | 0 | 0 | 1 | major sixth |
| | 0 | 1 | 1 | 1 | perfect firth |
| | 0 | 1 | 0 | 0 | major third |

Besides, the bass pattern assignment circuit 7 generates an attack signal ATK for switching the playing to auto-bass accompaniment in which a bass tone corresponding to the chord is automatically generated. A 4-bit degree signal $B_1$, $B_2$, $B_4$, $B_8$ which is transmitted from the bass pattern assignment circuit 7 and which assigns the subtonic of the autobass note, various control signals from a one-finger mode control circuit 9 being used when the electronic musical instrument executes the automatic accompaniment in a one-finger chord playing mode, and a control signal which is delivered from an octave control circuit 10 and which controls the octave of the bass tone output are respectively applied to a multiplexer 11, in which they are converted into time-divided signals with the timing signals $T_1, T_2 \ldots, T_{10}$. The time-divided signals are applied to a terminal ib of the automatic accompanying circuit 1 by a single control line. Here, the degree signals $B_1$, $B_2$, $B_4$, $B_8$ are 4-bit binary serial timing signals and are allotted as indicated in Table 5.

TABLE 5

| Timing | Degree 1° | minor 2° | major 2° | minor 3° | major 3° | perf. 4° | dim. 5° | perf. 5° | minor 6° | major 6° | minor 7° | major 7° |
|---|---|---|---|---|---|---|---|---|---|---|---|---|
| $T_7$ (MSB) | | | | | | | | | 1 | 1 | 1 | 1 |
| $T_8$ | | | | | 1 | 1 | 1 | 1 | | | | |
| $T_9$ | | | 1 | 1 | | | 1 | 1 | | | 1 | 1 |
| $T_{10}$ (LSB) | | 1 | | 1 | | 1 | | 1 | | 1 | | 1 |

Further applied to the terminal ib are a signal for the switching (major→minor) or (major→seventh) of an auto-bass tone to be described later, a signal for the switching (major→minor) or (major→seventh) of an auto-chord note assigning signal ACC to be also described later, and an octave signal.

Figure 6:
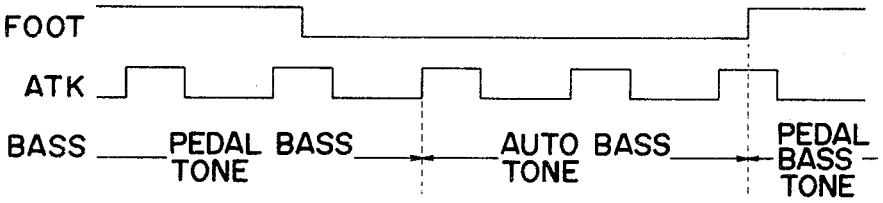
FIG. 6 is a timing diagram which illustrates the operation of a pedal/auto-bass switching signal generator circuit.

A terminal 'bass' of the automatic accompanying circuit 1 provides therefrom an auto-bass tone signal or a bass tone signal of the note assigned by the pedal-designated signal $I_P$. The switching between the pedal bass tone signal and the auto-bass tone signal is effected by the attack signal ATK. In case where the pedal is preferential and where a FOOT signal does not exist, the switching to the auto-bass tone is done in synchronism with the leading edge of the attack signal ATK as illustrated in FIG. 6. In the case where a plurality of pedals have been simultaneously depressed, the bass tone of the lowest note is delivered.

Figure 7:
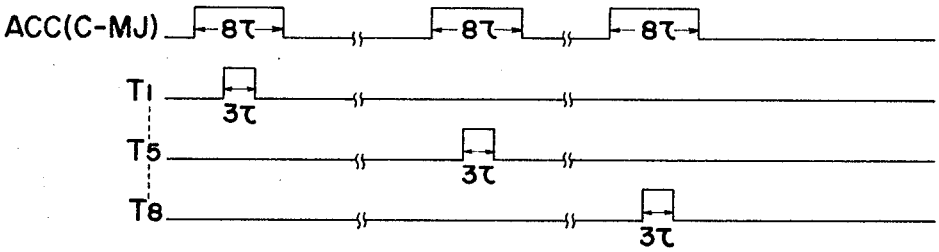
FIG. 7 is a timing diagram which illustrates the relations between an ACC signal and timing signals.

The auto-bass tone is a note output obtained in such a way that an auto-bass note assignment signal $I_B$ applied to the terminal ib and the root note of a detected chord are added, whereupon the sum is subjected to a divide-by-13 correction. From a terminal 'acc' of the automatic accompanying circuit 1, the auto-chord note assignment signals ACC for auto-chord accompaniment are delivered as serial timing signals. The truth table of the ACC signals is as indicated in Table 6-1, Table 6-2 and Table 6-3. Table 6-1 corresponds to the major chord and the erroneous key depression, Table 6-2 diminish chord, and Table 6-3 the minor, seventh and augment chords. Numeral "1" denotes a high level, and blank a low level. FIG. 7 illustrates the relations between the auto-chord note assignment signal ACC and the timing signals $T_1, \ldots, T_{13}$ in the case of the C major chord.

TABLE 6-1

| Chord | Root note | ACC $T_1$ | $T_2$ | $T_3$ | $T_4$ | $T_5$ | $T_6$ | $T_7$ | $T_8$ | $T_9$ | $T_{10}$ | $T_{11}$ | $T_{12}$ | $T_{13}$ |
|---|---|---|---|---|---|---|---|---|---|---|---|---|---|---|
| | C | 1 | | | | 1 | | | 1 | | | | | |
| | C# | | 1 | | | | 1 | | | 1 | | | | |
| | D | | | 1 | | | | 1 | | | 1 | | | |
| Major | D# | | | | 1 | | | | 1 | | | 1 | | |
| | E | | | | | 1 | | | | 1 | | | 1 | 1 |
| & | F | 1 | | | | | 1 | | | | 1 | | | |
| | F# | | 1 | | | | | 1 | | | | 1 | | |
| | G | | | 1 | | | | | 1 | | | | 1 | 1 |
| Erroneous | G# | 1 | | | 1 | | | | | 1 | | | | |
| key | A | | 1 | | | 1 | | | | | 1 | | | |
| depression | A# | | | 1 | | | 1 | | | | | 1 | | |
| | B | | | | 1 | | | 1 | | | | | 1 | 1 |
| Note assignment | | C | C# | D | D# | E | F | F# | G | G# | A | A# | | B |

TABLE 6-2

| Chord | Root note | ACC $T_1$ | $T_2$ | $T_3$ | $T_4$ | $T_5$ | $T_6$ | $T_7$ | $T_8$ | $T_9$ | $T_{10}$ | $T_{11}$ | $T_{12}$ | $T_{13}$ |
|---|---|---|---|---|---|---|---|---|---|---|---|---|---|---|
| | C | 1 | | | 1 | | | 1 | | | 1 | | | |
| | C# | | 1 | | | 1 | | | 1 | | | 1 | | |
| | D | | | 1 | | | 1 | | | 1 | | | 1 | 1 |
| | D# | 1 | | | 1 | | | 1 | | | 1 | | | |
| | E | | 1 | | | 1 | | | 1 | | | 1 | | |
| | F | | | 1 | | | 1 | | | 1 | | | 1 | 1 |
| Diminish | F# | 1 | | | 1 | | | 1 | | | 1 | | | |
| | G | | 1 | | | 1 | | | 1 | | | 1 | | |
| | G# | | | 1 | | | 1 | | | 1 | | | 1 | 1 |
| | A | 1 | | | 1 | | | 1 | | | 1 | | | |
| | A# | | 1 | | | 1 | | | 1 | | | 1 | | |
| | B | | | 1 | | | 1 | | | 1 | | | 1 | 1 |
| Note assignment | | C | C# | D | D# | E | F | F# | G | G# | A | A# | | B |

TABLE 6-3

| Chord | Root note | ACC $T_1$ | $T_2$ | $T_3$ | $T_4$ | $T_5$ | $T_6$ | $T_7$ | $T_8$ | $T_9$ | $T_{10}$ | $T_{11}$ | $T_{12}$ | $T_{13}$ |
|---|---|---|---|---|---|---|---|---|---|---|---|---|---|---|
| | C | 1 | | | 1 | | | | 1 | | | | | |
| | C# | | 1 | | | 1 | | | | 1 | | | | |
| | D | | | 1 | | | 1 | | | | 1 | | | |
| | D# | | | | 1 | | | 1 | | | | 1 | | |
| | E | | | | | 1 | | | 1 | | | | 1 | 1 |
| Minor | F | 1 | | | | | 1 | | | 1 | | | | |
| | F# | | 1 | | | | | 1 | | | 1 | | | |
| | G | | | 1 | | | | | 1 | | | 1 | | |
| | G# | | | | 1 | | | | | 1 | | | 1 | 1 |
| | A | 1 | | | | 1 | | | | | 1 | | | |
| | A# | | 1 | | | | 1 | | | | | 1 | | |
| | B | | | 1 | | | | 1 | | | | | 1 | 1 |
| | C | 1 | | | | 1 | | | 1 | | | 1 | | |
| | C# | | 1 | | | | 1 | | | 1 | | | 1 | 1 |
| | D | 1 | | 1 | | | | 1 | | | 1 | | | |
| | D# | | 1 | | 1 | | | | 1 | | | 1 | | |
| | E | | | 1 | | 1 | | | | 1 | | | 1 | 1 |
| Seventh | F | 1 | | | 1 | | 1 | | | | 1 | | | |
| | F# | | 1 | | | 1 | | 1 | | | | 1 | | |
| | G | | | 1 | | | 1 | | 1 | | | | 1 | 1 |
| | G# | 1 | | | 1 | | | 1 | | 1 | | | | |
| | A | | 1 | | | 1 | | | 1 | | 1 | | | |
| | A# | | | 1 | | | 1 | | | 1 | | 1 | | |
| | B | | | | 1 | | | 1 | | | 1 | | 1 | 1 |
| | C | 1 | | | | 1 | | | 1 | | | | | |
| | C# | | 1 | | | | 1 | | | | 1 | | | |
| | D | | | 1 | | | | 1 | | | | 1 | | |
| | D# | | | | 1 | | | | 1 | | | | 1 | 1 |
| | E | 1 | | | | 1 | | | | 1 | | | | |
| Augment | F | | 1 | | | | 1 | | | | 1 | | | |
| | F# | | | 1 | | | | 1 | | | | 1 | | |
| | G | | | | 1 | | | | 1 | | | | 1 | 1 |
| | G# | 1 | | | | 1 | | | | 1 | | | | |
| | A | | 1 | | | | 1 | | | | 1 | | | |
| | A# | | | 1 | | | | 1 | | | | 1 | | |

TABLE 6-3-continued

| Chord | Root note | ACC | | | | | | | | | | | | |
|---|---|---|---|---|---|---|---|---|---|---|---|---|---|---|
| | | $T_1$ | $T_2$ | $T_3$ | $T_4$ | $T_5$ | $T_6$ | $T_7$ | $T_8$ | $T_9$ | $T_{10}$ | $T_{11}$ | $T_{12}$ | $T_{13}$ |
| | B | | | | 1 | | | | 1 | | | | 1 | 1 |
| Note assignment | | C | C# | D | D# | E | F | F# | G | G# | A | A# | | B |

Such auto-chord note assignment signals are supplied to a demultiplexer 12, in which they are timed by the timing signals $T_1 \ldots, T_{12}$ and are converted into parallel d.c. signals for assigning twelve auto-chord tones (C, C#, . . . , B). The parallel d.c. signals are sent to a chord tone generator 13, to generate the auto-chord tone assigned by the auto-chord note signal. The auto-chord tone is timed by the rhythm timing signal transmitted from the rhythm pulse generator 8*b*, and becomes an automatic chord accompanying tone.

The signal BASS from the 'bass' terminal has, in a timing gate circuit 14, its rhythm timing established by the ATK signal transmitted from the bass pattern assignment circuit 7. A memory switch circuit 15 is a circuit for controlling a memory operation, i.e., an operation in which the automatic accompaniment is continued even when the accompanying key is released and in which the assigned bass tone is sustained and delivered even when the pedal is released. A signal of the memory switch circuit 15 controls the passage through a control gate circuit 16, of a signal KEY transmitted from a terminal 'key'. The KEY signal consists of the serial timing signals $T_{01}$, $T_{01}$ indicative of whether the accompanying key and the pedal are in the depressed state or in the released state. Numeral 17 indicates a demultiplexer. A timbre mixer 18 forms the timbre of the chord tone signal as well as the BASS signal. The timbre signal is supplied to an amplifier 20 together with a rhythm signal of a rhythm tone circuit 19. A loudspeaker 21 is driven by an output of the amplifier 20.

II Construction and Operation of Automatic Accompanying Circuit

Referring to the circuit diagram of FIG. 2, there will be explained how output signals are formed and delivered in response to various input signals supplied to the automatic accompanying circuit 1. It is a timing pulse generator 30 that converts the clock pulses from the clock pulse generaor 2 into various timing pulses $\tau_3$, $\tau_5$, $\tau_3+\tau_4+\tau_5$, $\tau_5+ \ldots +\tau_8$ (refer to FIG. 3) within the automatic accompanying circuit 1. These timing pulses are supplied to various circuits. The accompanying key assignment signal $I_K$ is waveshaped by a timing signal waveshaping circuit 31 and then sent to a chord detector 32. As previously stated, in response thereto the chord detector 32 generates the 3-bit binary chord signal CH1, CH2, CH3, which is then sent to and stored in a chord memory 37. Simultaneously, the chord detector 32 generates a chord coincidence pulse signal ACRD and sends it to a chord/root note write-in pulse generator 33. Besides, it transmits to an accompanying key ON-OFF signal detector circuit 34 an ALL-OFF signal for detecting that none of the accompanying keys is depressed. A re-depression of the accompanying keyboard is detected by a keying detector 35, and the detection output is used to control an inhibit time generator 36. Thus, at the key change at which the accompanying keys are turned "on" and "off", the operation of the chord/root note write-in pulse generator 33 is ceased for a fixed time so as to prevent the operation of detecting a chord unfavorable for the performance.

While the chord signal CH1, CH2, CH3 is delivered directly from the chord terminals, it is decoded by a decoder 38 into the chord type signal (major, minor, . . . ) or the erroneous key depression signal ER. When a control signal of ACC-m or ACC-7th exists in an ACC-m, 7th control circuit 39, an output from the decoder 38 is converted into a signal of m (minor) or 7th (seventh) irrespective of the chord type signal transmitted from the decoder 38. On the other hand, when the ACC-m or ACC-7th control signal is not applied, the output of the decoder 38 is supplied to an ACC signal generator 40 as it is, and the note assignment signal ACC for the auto-bass accompaniment is generated.

The pedal assignment signal $I_P$ is waveshaped by a timing signal waveshaping circuit 41 and then supplied to a pedal note detector 42, which generates a note detecting pulse signal PED-P for detecting the note of the pedal and also a pedal depression signal FOOT. The pedal depression signal FOOT is supplied to a pedal-/auto-bass switching signal generator 43 along with a signal ATK-P supplied from an ATK (attack) pulse generator 44, thereby to generate a signal PEDAL for switching the ordinary performance with the pedal and the auto-bass accompaniment. When the ATK-P signal is applied in the absence of the pedal depression signal FOOT transmitted from the pedal note detector 42, the operation is switched to the auto-bass accompaniment. A signal PEDAL-ON from the pedal/auto-bass switching signal generator 43 as indicates the depression of the pedal and a signal MANU-ON from the ACC ON-OFF signal generator 34 as indicates the depression of the accompanying key are time-divided by the timing signals $T_{01}$, $T_{02}$ in a multiplexer 50, whereupon they are delivered from the 'key' terminal as the KEY signal.

A note signal generator 51 generates binary-word note signals $N_8$, $N_4$, $N_2$, $N_1$ as in Table 7 corresponding to the twelve notes $C_L$, C#, . . . , B of the accompanying keys and the thirteen notes $C_L$, C#, . . . , $C_H$ of the pedals.

TABLE 7

| Note | Binary word | | | |
|---|---|---|---|---|
| | $N_8$ | $N_4$ | $N_2$ | $N_1$ |
| $C_L$ | 0 | 0 | 0 | 0 |
| C# | 0 | 0 | 0 | 1 |
| D | 0 | 0 | 1 | 0 |
| D# | 0 | 0 | 1 | 1 |
| E | 0 | 1 | 0 | 0 |
| F | 0 | 1 | 0 | 1 |
| F# | 0 | 1 | 1 | 0 |
| G | 0 | 1 | 1 | 1 |
| G# | 1 | 0 | 0 | 0 |
| A | 1 | 0 | 0 | 1 |
| A# | 1 | 0 | 1 | 0 |
| B | 1 | 0 | 1 | 1 |
| $C_H$ | 1 | 1 | 0 | 0 |

These note signals representative of the respective notes are decoded into the corresponding timing signals $T_{01}$, $T_{02}$, . . . , $T_{013}$ (refer to FIG. 4) by a decoder 52. Such decoder outputs are made the timing signals $T_1$, $T_2$, . . . , $T_{13}$ narrowed by the timing pulse $\tau_3+\tau_4+\tau_5$ (refer to FIG. 5) by means of a gate circuit 53. The narrowed timing pulses are respectively delivered from the terminals $t_1$, $t_2$, . . . , $t_{13}$ so as to subject the external circuits to the time-division control.

Figure 8:
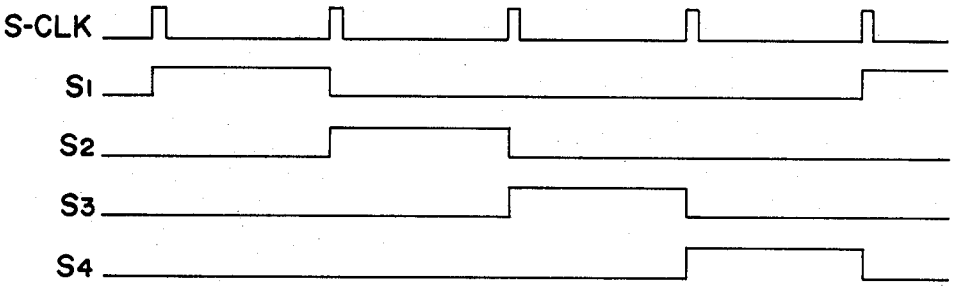
FIG. 8 is an operating timing diagram of a sequence signal generator circuit.

A signal S-CLK generated from the note signal generator 51 is supplied to a sequence control signal generator 54, to generate sequence signals $S_1$, $S_3$, $S_4$ (refer to FIG. 8) for the time-division control of various circuits. As illustrated in FIG. 2, the sequence control signal $S_2$ is not actually supplied by the sequence control signal generator. $S_2$ in FIG. 8 stands for a delay time of S-CLK between the signals $S_1$ and $S_3$. During the delay time $S_2$, a chord detection is carried out by the chord detector 32. Further, various control signals received at the ib terminal are converted from serial signals into parallel signals by a demultiplexer 55 and become various d.c. signals. Among them, a 4-bit binary signal output $I_8$, $I_4$, $I_2$, $I_1$ which changes the major third signal into the minor third signal when the BASS-m control signal is applied to a BASS-m, 7th control circuit 56, and it changes the perfect fifth signal into the minor seventh signal when the BASS-7th control signal is applied. The 4-bit binary degree signal is supplied to an adder 57, in which it is added to a 4-bit binary root note signal from an accompanying key root note memory 58 so as to make a scale correction. Here, the root note memory 58 stores the root note in such a way that the 4-bit note signal of the note signal generator 51 is latched at the timing of a signal ACD-P prepared from the key depression signal $I_K$ of the accompanying key.

A pedal/auto-bass switching circuit 59 selects a binary signal from the adder 57 or a pedal note memory 60 by the use of the PEDAL signal, and transmits it to a divide-by-13 correction circuit 61. Also the pedal note memory 60 stores the root note in such a way that the 4-bit note signal of the note signal generator 51 is latched by a signal PED-P prepared from the pedal depression signal $I_P$ of the pedal. In the divide-by-13 correction circuit 61, when the added value in the adder 57 exceeds a digital value corresponding to the bass note $C_H$, it is corrected to a digital value of the corresponding bass note. Besides, the divide-by-13 correction circuit 61 transmits to an octave switching circuit 62 a signal OCTAVE for controlling the octave of the bass tone. A 4-bit binary note signal $B_1$, $B_2$, $B_4$, $B_8$ from the divide-by-13 correction circuit 61 as assigns the bass note is converted by a decoder 63 into a d.c. signal for assigning the bass note. Thereafter, a bass tone signal of the assigned bass note $C_L$, C#, . . . , $C_H$ is generated by a bass tone generator 64, and the bass tone signal BASS is delivered from the 'bass' terminal via the octave switching circuit 62.

In this manner, the automatic accompaniment is effected by the automatic accompanying circuit and the peripheral circuits connected thereto. Hereunder, the principal circuits will be described more in detail.

III. Generation of Parallel Timing Signals

Figure 9:
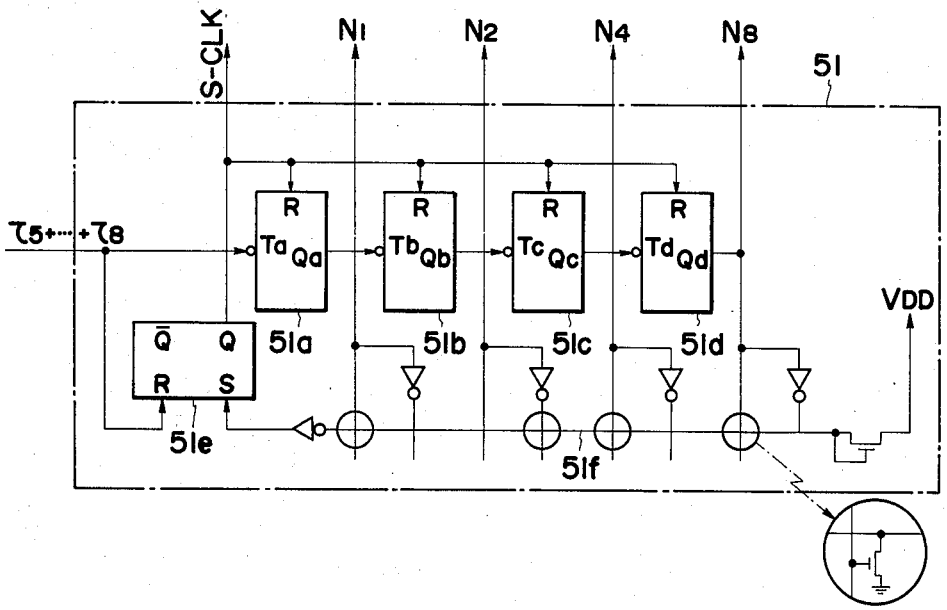
FIG. 9 is a schematic diagram of the note signal generator.
Figure 10:
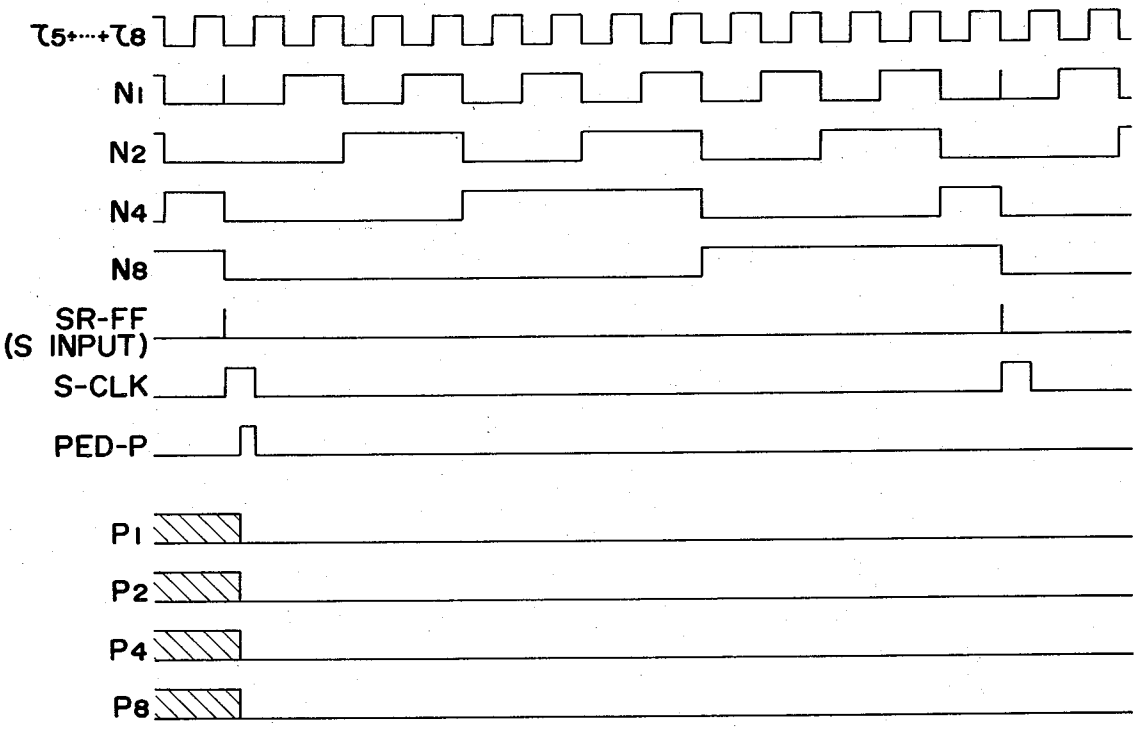
FIG. 10 is a timing diagram which shows input and output signals of the note signal generator and a pedal note detector circuit.

Using the timing pulse $\tau_5+\ldots+\tau_8$ produced by the timing pulse generator 30, the parallel timing signals are made by the note signal generator 51, the decoder 52 and the gate circuit 53. As shown in FIG. 9, the note signal generator 51 comprises four toggle flip-flops with reset terminals, 51*a*, 51*b*, 51*c* and 51*d*, and one flip-flop with set and reset terminals, 51*e*. A terminal $T_a$ of the toggle flip-flop 51*a* at the first stage is supplied with the timing pulse $\tau_5+\ldots+\tau_8$ generated by the timing pulse generator 30. Output-side terminals $Q_a$, $Q_b$, . . . of the respective toggle flip-flops are connected to input-side terminals $T_b$, $T_c$ and $T_d$ of the succeeding-stage toggle flip-flops 51*b*, 51*c* and 51*d* and to a ROM (read only memory) line 51*f*. An output of the ROM line 51*f* is applied to the reset terminals of the toggle flip-flops 51*a*, . . . and 51*d* through the flip-flop 51*e* having the set and reset terminals, so as to execute the divide-by-13 operation. On the output side of the note signal generator 51, accordingly, the note signal $N_1$, $N_2$, $N_4$, $N_8$ of the binary word indicated in Table 7 and FIG. 10 is provided. The S terminal of the flip-flop 51*e* having the set and reset terminals is supplied with a signal SR-FF illustrated in FIG. 10, while a terminal Q provides a signal S-CLK.

Figure 11:
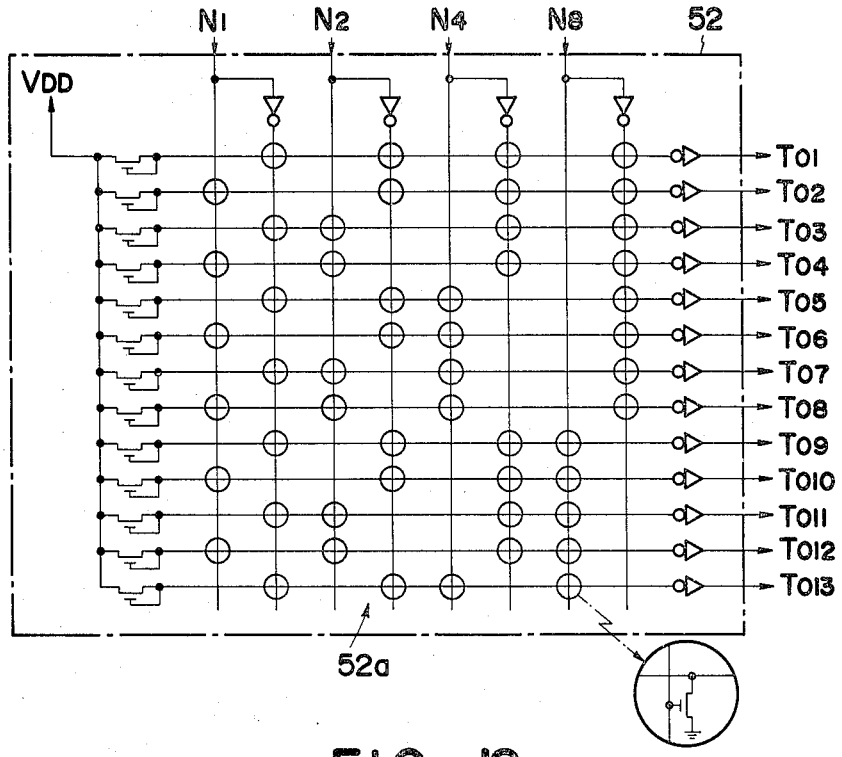
FIG. 11 is a schematic diagram of the decoder.

The note signals representative of the respective notes are decoded into the corresponding timing signals $T_{01}$, $T_{02}$, . . . , and $T_{013}$ (refer to FIG. 4) by the decoder 52. An example of a concrete circuit of the decoder 52 is shown in FIG. 11. The decoder 52 has a ROM circuit 52*a*, in which vertical ROM lines receive the note signal $N_1$, $N_2$, $N_4$, $N_8$ and lateral ROM lines provide the timing signals $T_{01}$, . . . , and $T_{013}$. Such outputs become the timing signals $T_1$, . . . , and $T_{13}$ narrowed by the timing pulse $\tau_3+\tau_4+\tau_5$ (refer to FIG. 5) in the gate circuit 53 (FIG. 2). The narrowed timing signals are delivered from the terminals $t_1$, . . . , and $t_{13}$ and supplied to the pedal keyboard circuit 3 and the accompanying keyboard circuit 4 as described before.

IV. Input Circuit Portions for Key Depression Signals

The key depression signals converted into the serial timing signals by the OR circuits 5 and 6 enter the automatic accompanying LSI circuit. The input circuit portions of the LSI circuit are the timing signal waveshaping circuits 31 and 41. The details of the timing signal waveshaping circuit 31 are shown in FIG. 12, and the operating timing diagram thereof is given in FIG. 13.

Figure 13:
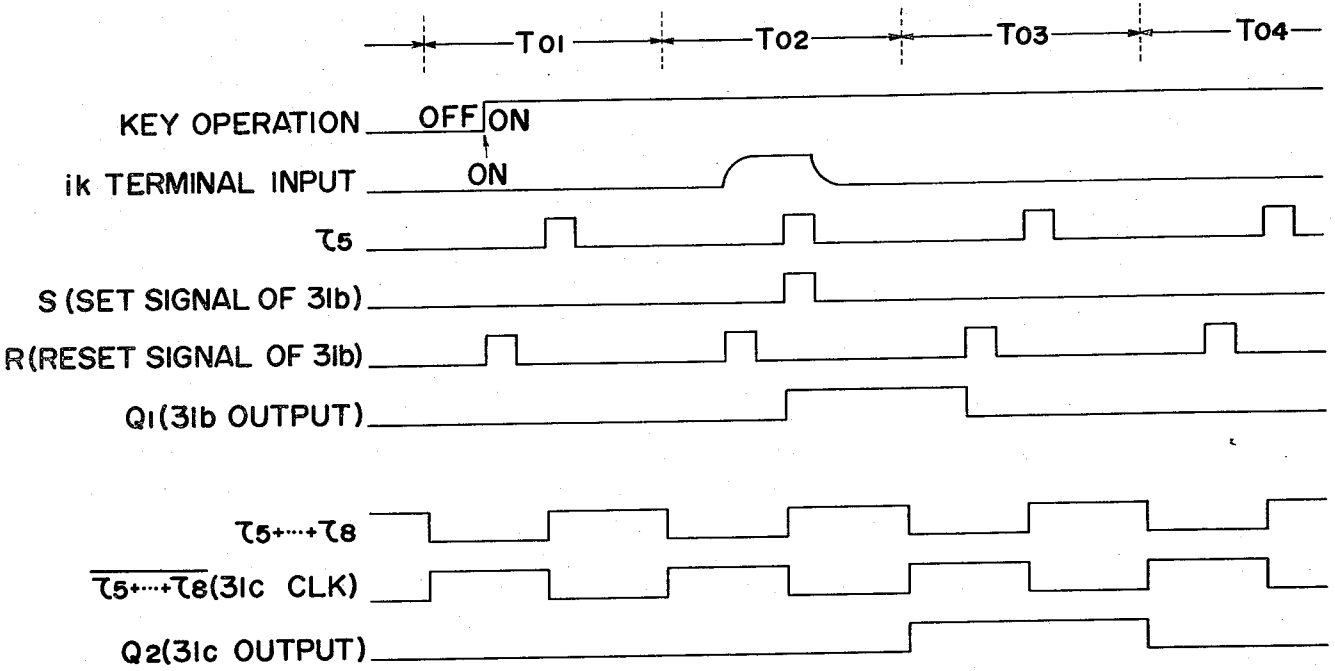
FIG. 13 is an operating timing diagram of the timing signal waveshaping circuit at the time when key D is depressed.

The timing signal waveshaping circuit 31 is constructed of an AND gate 31*a*, an SR flip-flop 31*b*, a delayed flip-flop 31*c* and an inverter 31*d*. The ik terminal input is impressed on one input terminal of the AND gate 31*a*, while the timing pulse $\tau_5$ is applied to the other input terminal as a strobe signal. A strobed output signal of the AND gate 31*a* is a set signal of the SR flip-flop 31*b*. An output $Q_1$ of the SR flip-flop 31*b* is sent to the delayed flip-flop 31*c*, in which it is delayed one timing (one bit) by employing as a clock signal the inverted signal of the timing pulse $\tau_5+\ldots+\tau_8$ owing to the inverter 31*d* and becomes a waveshaped signal SIK. The timing pulse $\tau_3$ is impressed on a reset terminal of the SR flip-flop 31*b*, to reset a stored content of this flip-flop 31*b*. Assuming by way of example that key D has been depressed, the key depression signal enters the ik input terminal at the timing $T_{02}$ as illustrated in FIG. 13. The key depression signal is supplied to the AND gate 31*a*, strobed by the timing signal $\tau_5$ and supplied to the SR flip-flop 31*b*. If the width of the pulse obtained by the strobing is equal to or greater than a set-up time of the SR flip-flop 31*b*, the presence of an input is judged, and the SR flip-flop 31*b* is set. The set state is held until the next reset pulse (timing pulse $\tau_3$) arrives. The $Q_1$ output is supplied to the delayed flip-flop 31*c* and is stored at the inverted timing pulse $\overline{\tau_5+\ldots+\tau_8}$, so that the SIK signal is delivered at the timing $T_{03}$ one timing (one bit) later.

In electronic musical instruments in which, as in the automatic accompanying apparatus, the time-divided serial note assignment signals are prepared with the timing output signals of their own, it is necessary to solve the problem of time lags and to improve the response characteristic at the key depression, thereby to prevent malfunctions due to noise etc. The time lags consist mainly of lags attributed to wiring capacitances of the pedal keyboard and the manual keyboard, and time lags in the OR gates for taking the sums of the signals corresponding to the respective keys. As a measured against such time lags, it is thought that the pulse width may be extended. The extension of the pulse width, however, results in lowering the frequency of the timing output signals and lengthening the response time at the key depression. It is therefore impracticable.

Figure 12:
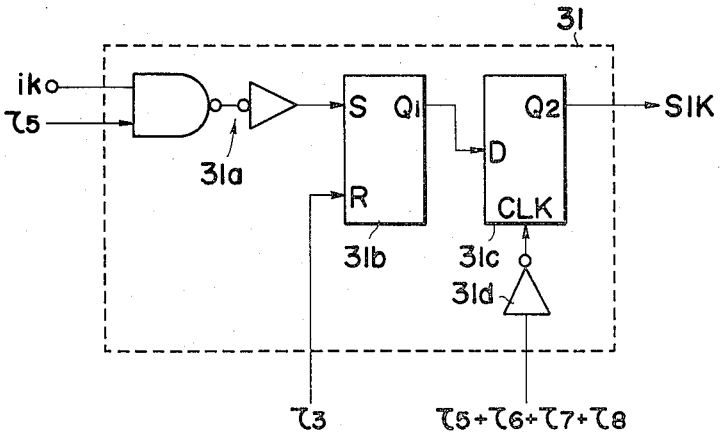
FIG. 12 is a schematic diagram which shows a timing signal waveshaping circuit.

In contrast, when the circuit arrangement as shown in FIG. 12 is adopted, the final period of the pulse having entered the ik terminal is strobed, so that the operation is possible even in the presence of the delay approximately equal to the pulse width. The illustrated circuit arrangement is also effective for signals including chattering as in case where the signals are turned "on" and "off" directly by keys. Furthermore, under a bad condition under which a noise is induced, even when the noise is induced in a period other than the strobing period, no malfunction occurs because the input signal is strobed. Since the strobing is carried out in $\frac{1}{8}$ of the whole period, the circuit of the embodiment is 8 times higher in the pulse immunity than a circuit in which the measured is not taken. When, in an actual circuit, a pulsatile noise is induced to cause a malfunction, a capacitor may be incorporated in the input line of the ik terminal so as to absorb the pulse energy.

The SIK signal thus prepared is sent to the chord detector 32 to detect a chord of the SIK signal, and the detected chord is converted to the 3-bit binary chord signal CH1, CH2, CH3 as described previously.

The timing signal waveshaping circuit 41 into which the pedal assignment signal $I_P$ transmitted from the pedal keyboard 3 is entered is constructed and operated similarly to the timing signal waveshaping circuit 31 set forth above. The waveshaped signal is sent to the pedal note detector 42.

V. Preferential Detection of One of Pedal Notes

Figure 14:
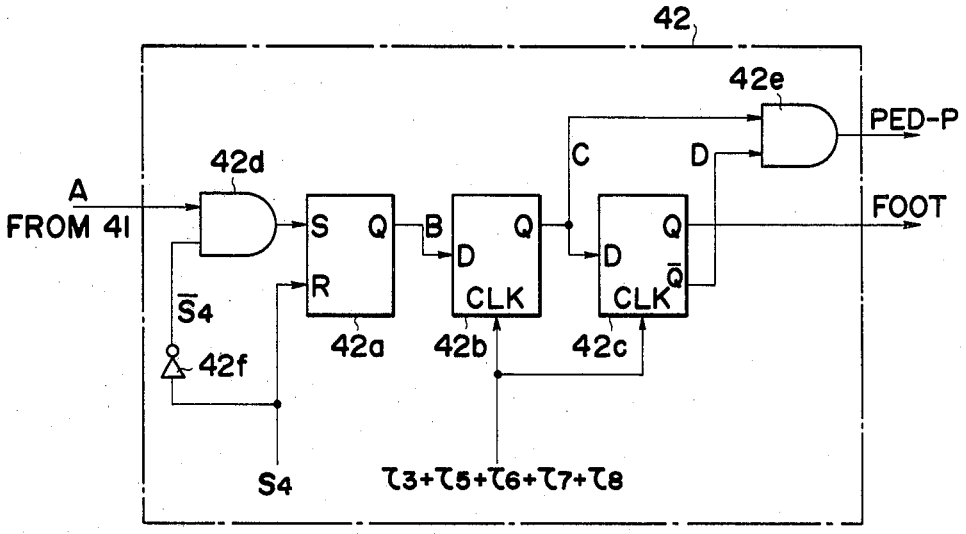
FIG. 14 is a schematic diagram of the pedal note detector circuit.

Electronic musical instruments having a pedal keyboard require a preference function according to which, when a plurality of pedals are concurrently depressed, any one of the pedal notes is preferentially detected and the corresponding tone is given forth. The key depression signal waveshaped by the timing signal waveshaping circuit 41 is supplied to the pedal note detector 42, to generate the note detection pulse PED-P for detecting the note of the depressed pedal and to generate the pedal depression signal FOOT. The pedal note detector 42 has the lowest-note preferential detection function in itself. Referring to FIG. 14, the pedal note detector 42 is constructed of a cascade connection circuit consisting of an S-R flip-flop 44*a* and two D-type flip-flops 44*b* and 44*c*, two AND circuits 44*d* and 44*e*, and an inverter 44*f*. One input terminal of the input-side AND circuit 44*d* receives the output signal from the timing signal waveshaping circuit 41, while an output of the AND circuit 44*d* is coupled to an S terminal of the S-R flip-flop 44*a*. The $\tau_3+\tau_5+\ldots+\tau_8$ pulse from the timing pulse generator 30 is supplied to clock terminals of the D-type flip-flops 44*b* and 44*c*.

Figure 15:
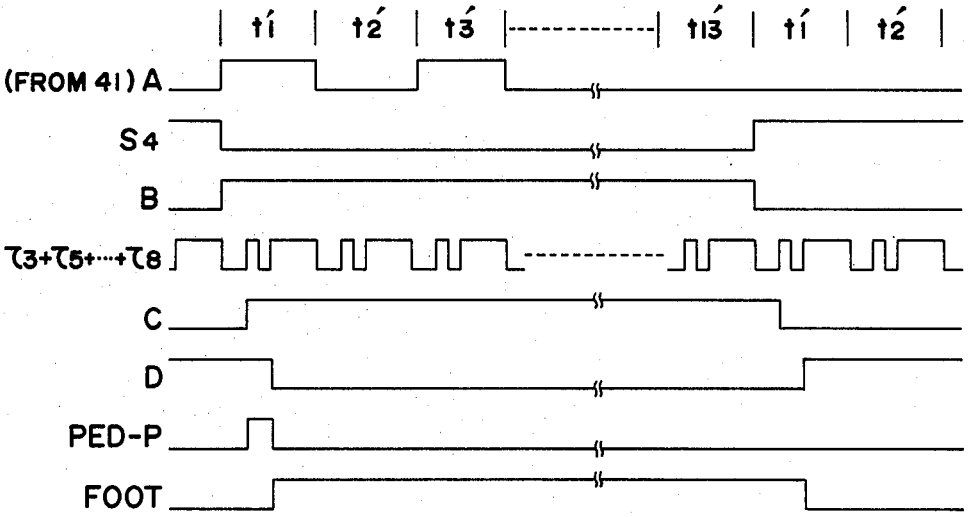
FIG. 15 is a timing diagram of input and output signals of the pedal note detector circuit in the case where keys $C_L$ and D are concurrently depressed.

Here, the circuit operation will be explained by supposing a case where the keys of two notes $C_L$ and D have been concurrently depressed. The relationship among the signals of various parts of the circuit is illustrated in FIG. 15. Upon the concurrent depression of the two pedals of notes $C_L$ and D, the timing signals $T_{13}$ and $T_2$ are entered into the ip terminal. They are delayed one bit and have the pulse width enlarged by the timing signal waveshaping circuit 41, to be waveshaped into timing signals corresponding to those $T_{01}$ and $T_{03}$. The waveshaped signal A is supplied to the AND circuit 44*d*. Accordingly, $t'_1$ corresponds to the timing signal $T_{13}$, and $t'_3$ to the timing signal $T_2$. In the AND circuit 44*d*, the product between the signal A and a signal $S_4$ obtained by inverting the sequence signal $\overline{S_4}$ from the sequence control circuit 54 by means of the inverter 44*f* is taken, the product being applied to the S terminal of the S-R flip-flop 44*a*. As a result, a signal B is delivered from the Q terminal of the S-R flip-flop 44*a* and is entered into a D terminal of the D-type flip-flop 44*b*. Since the time pulse $\tau_3+\tau_5+\ldots+\tau_8$ is supplied to the clock terminal CLK of the D-type flip-flop 44*b*, a signal C arises at a Q terminal of the D-type flip-flop 44*b*. The signal C is supplied to the D-type flip-flop 44*c* at the succeeding stage, and the signal FOOT provided from a Q terminal of the flip-flop 44*c* is sent to the pedal-/auto-bass switching signal generator 43. The signal C is supplied to the output-side AND circuit 44*e* along with a signal at a terminal $\overline{Q}$ of the D-type flip-flop 44*c*. The output signal PED-P of the AND circuit 44*e* is applied to the pedal note memory 60. In this manner, the PED-P signal is the AND signal between the signal C and the $\overline{Q}$ terminal output. Therefore, only the signal of the timing corresponding to the lowest note in the signal A ($C_L$ in the case) is derived, and the other signal is not provided, so that the note detection pulse PED-P based on the lower note preference can be obtained.

Figure 16:
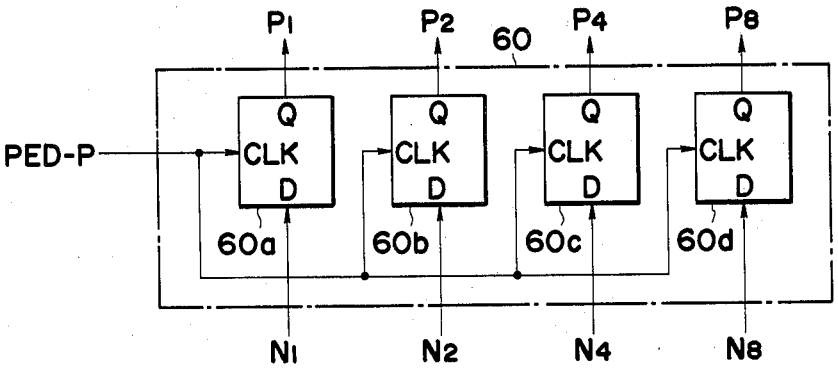
FIG. 16 is a schematic diagram of a pedal note memory circuit.

The note detection pulse PED-P is sent to the pedal note memory 60. With the PED-P signal, the pedal note memory 60 latches the note signal of four bits sequentially and cyclically generated in the note signal generator 51, to store the pedal assignment note. Referring to FIG. 16, the pedal note memory 60 is composed of four latch circuits 60*a*, 60*b*, 60*c* and 60*d*. The note detection pulse PED-P is supplied to clock terminals CLK of the respective latch circuits, while the 4-bit note signal $N_1$, $N_2$, $N_4$, $N_8$ from the note signal generator 51 is sequentially applied to data input terminals D thereof as illustrated in FIG. 10. Accordingly, the respective latch circuits 60*a*, . . . , and 60*d* latch the note signal bits $N_1$, $N_2$, $N_4$ and $N_8$ at the arrival of the note detection pulse PED-P, and they provide latch information $P_1$, $P_2$, $P_4$ and $P_8$ from Q terminals, the information being applied to the pedal/auto-bass switching circuit 59. Assuming by way of example that the pedal of note $C_L$ has been depressed (the same applies to a case where a plurality of keys have been simultaneously depressed and where the lowest note of the corresponding notes is $C_L$), the note detection pulse PED-P arrives at the timing corresponding to the particular note. At that time, the output $N_1$, $N_2$, $N_4$, $N_8$ of the note signal generator 51 is 0, 0, 0, 0 (refer to Table 7 and FIG. 10). Therefore, the information is latched, the latch circuit output $P_1$, $P_2$, $P_4$, $P_8$ becomes 0, 0, 0, 0 irrespective of the preceding information, and the key depression information is detected and stored. At this time, the pedal/auto-bass switching circuit has been switched to the "pedal" by the PEDAL signal generated from the pedal/auto-bass switching signal generator 43 owing to the foregoing FOOT signal, and it supplies the signal $P_1$, $P_2$, $P_4$, $P_8$ to the divide-by-13 circuit 61.

In case of electronic musical instruments controlled by the time-division system as in the automatic accompanying equipment, the pedal note detector can be endowed with the function of preferentially detecting one note, by exploiting the property that the key depression signals are serially entered with the timing of the respective notes shifted. Therefore, it is unnecessary to separately prepare any pedal preference circuit of complicated logic design, and the circuit arrangement can be simplified.

VI. Detection and Storage of Key Operation State

In electronic musical instruments of the time-division control system according to this invention, whether a key is in the depressed state or in the released state needs to be detected and stored at a keyboard operation. The reason therefor is as follows. Although a tone assignment signal exists in a key depression period, it is indicated by one shot of pulse in most cases. In spite of the key depression period, there occurs a time interval during which the signal indicative of the key depression does not exist at an input terminal. Under such a condition, a smooth musical-tone performance cannot be executed.

The detection and storage of the key operation state and the selection of a playing mode based thereon are done by the pedal note detector 42 and the pedal/auto-bass switching signal generator 43.

Figure 17:
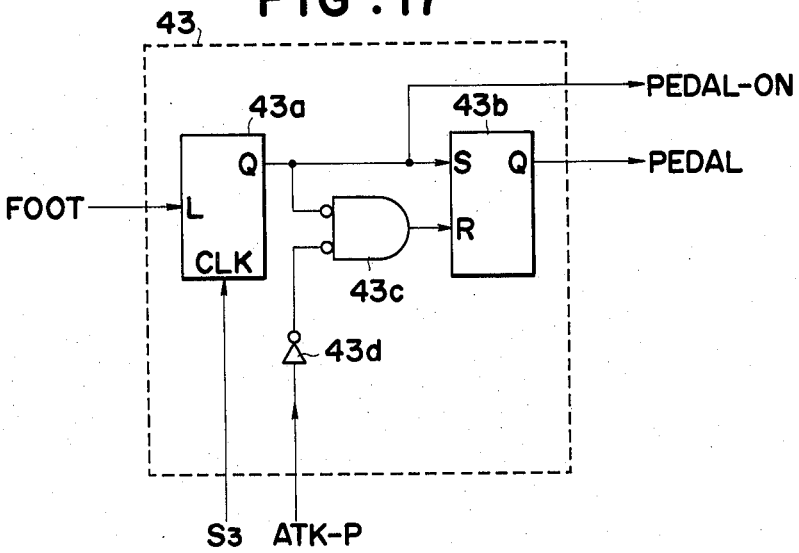
FIG. 17 is a schematic diagram of the pedal/auto-bass switching signal generator circuit.

The pedal assignment signal $I_P$ transmitted from the pedal keyboard 3 is waveshaped by the timing pulse waveshaping circuit 41 and supplied to the pedal note detector 42, to generate the pedal depression signal FOOT representing that a pedal is depressed. The pedal depression signal FOOT is sent to the pedal/auto-bass switching signal generator 43. Regarding the pedal note detector 42, refer to FIG. 14 and Chapter V. Referring now to FIG. 17, the pedal/auto-bass switching signal generator 43 is constructed of a latch circuit 43*a*, an S-R flip-flop 43*b*, an AND circuit 43*c* and an inverter 43*d*. The latch circuit 43*a* stores the pedal depression signal FOOT at the timing of the sequence signal $S_3$, and delivers the result as the PEDAL-ON signal. Simultaneously, the signal FOOT is sent to an S terminal of the S-R flip-flop 43*b* so as to generate the PEDAL signal which switches the performance by the pedal and the auto-bass accompaniment therebetween.

Figure 18:
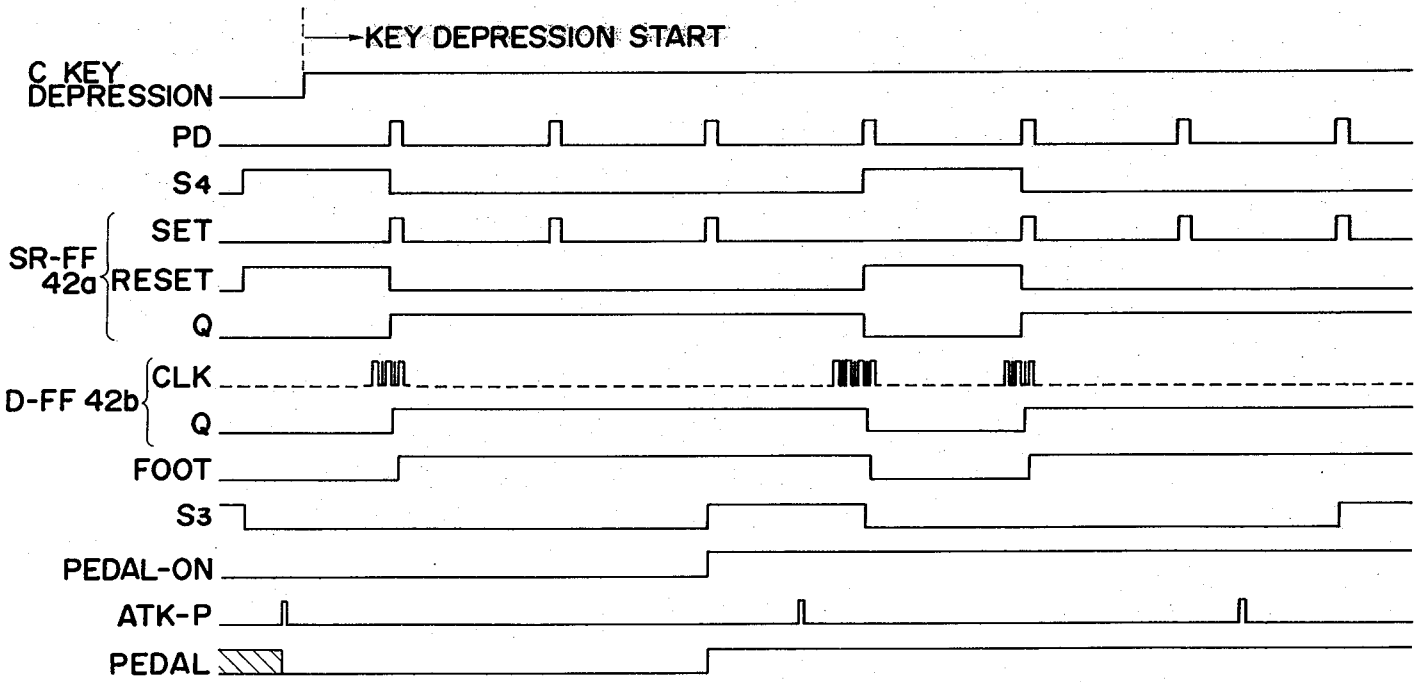
FIG. 18 is an operating timing diagram of the pedal-/auto-bass switching signal generator circuit at the initiation of a pedal depression.
Figure 19:
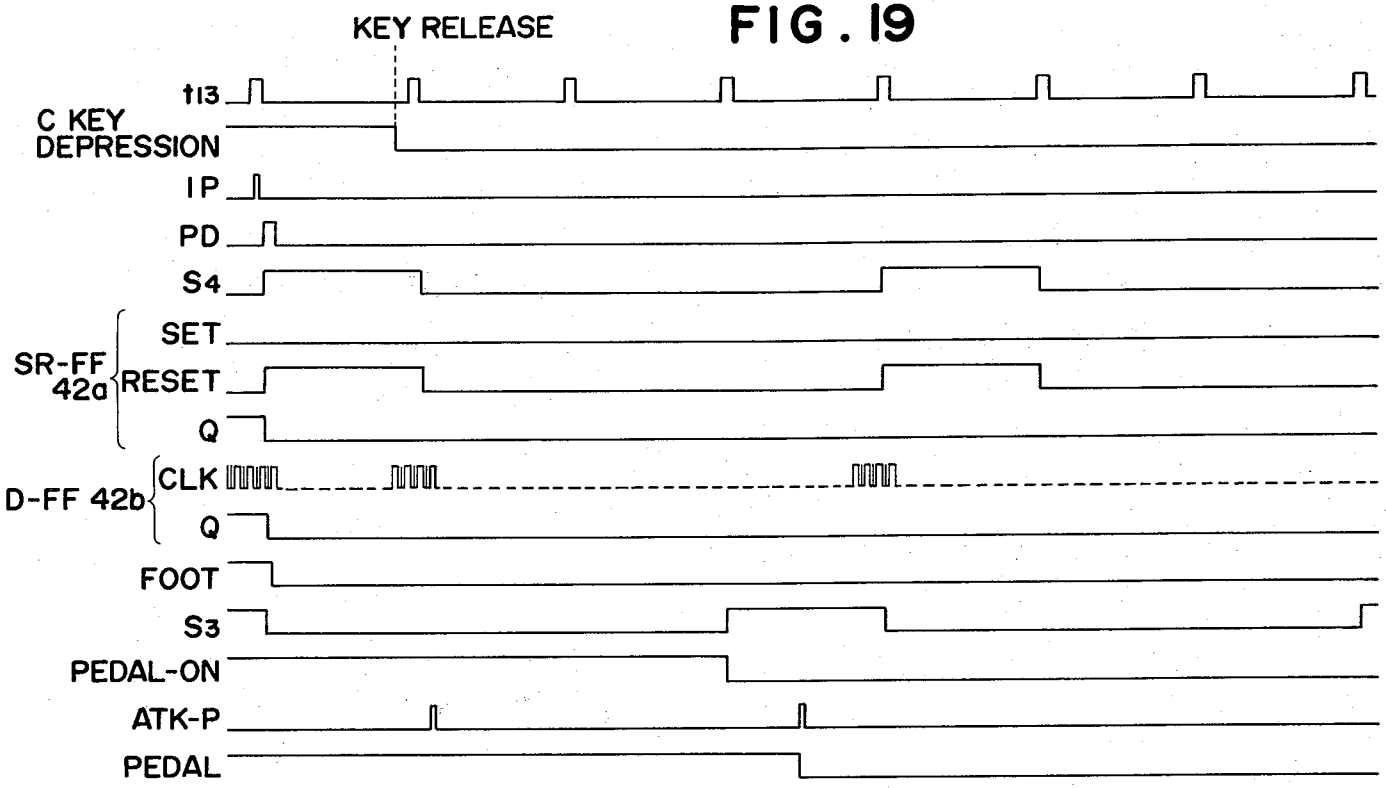
FIG. 19 is an operating timing diagram of the pedal-/auto-bass switching signal generator circuit at the termination of the pedal depression.

FIG. 18 is an operating timing diagram at the time of the initiation of the pedal depression. The S-R flip-flop 42*a* is normally reset by the sequence signal $S_4$. After the initiation of the key depression, the S-R flip-flop 42*a* is set by a tone assignment signal PD which enters first in a period other than the sequence signal $S_4$. The output Q of the S-R flip-flop 42*a* is transmitted to the two D-type flip-flops 42*b* and 42*c* by the clock pulse $\tau_3+\tau_5+\ldots+\tau_8$, to form the pedal depression signal FOOT. The FOOT signal is sent to the latch circuit 43*a* and latched by the sequence signal $S_3$, to form the PEDAL-ON signal representing that the pedal is in the depressed state. Since the S-R flip-flop 42*a* is reset by the sequence signal $S_4$, also the FOOT signal becomes the low level at a timing somewhat alter than the sequence signal $S_4$. Since, however, the PEDAL-ON signal is latched by the timing of the sequence signal $S_3$, the high level indicative thereof is held insofar as the key depression state continues. Conversely to the foregoing, FIG. 19 shows an operating timing diagram at the termination of the pedal depression. Upon the release of the key, the tone assignment signal PD is no longer entered. Therefore, the state under which the S-R flip-flop 42*a* has been reset by the sequence signal $S_4$ is still maintained. Accordingly, the pedal depression signal FOOT becomes the low level and holds it still at the sequence signal $S_3$, at which the PEDAL-ON signal becomes the low level for the first time. In this manner, the PEDAL-ON signal somewhat lags over the actual timings of the depression and release of the pedal, but it corresponds substantially to the key operations and maintains the high level as long as the key depression state continues.

Owing to the adoption of such a circuit arrangement, notwithstanding that when the tone assignment signals are composed by the use of the serial timing output signals the discrete signals are entered, the signals of periods approximately equal to those of actual key operations (key depression periods) can be secured. Thus, it can be selected, for example, whether the tone is produced only for the key depression period or the tone determined by the preceding key depression state is continued till the initiation of the next key depression after the key release.

VII. Chord Detection

In the automatic accompanying apparatus wherein the player assigns a chord name (such as C major and D minor) on the accompanying keyboard and wherein the automatic accompaniment of a bass tone and a chord tone according to the assignment is carried out, there is required a chord detector for detecting the chord name which the depressed accompanying key forms.

Figure 20:
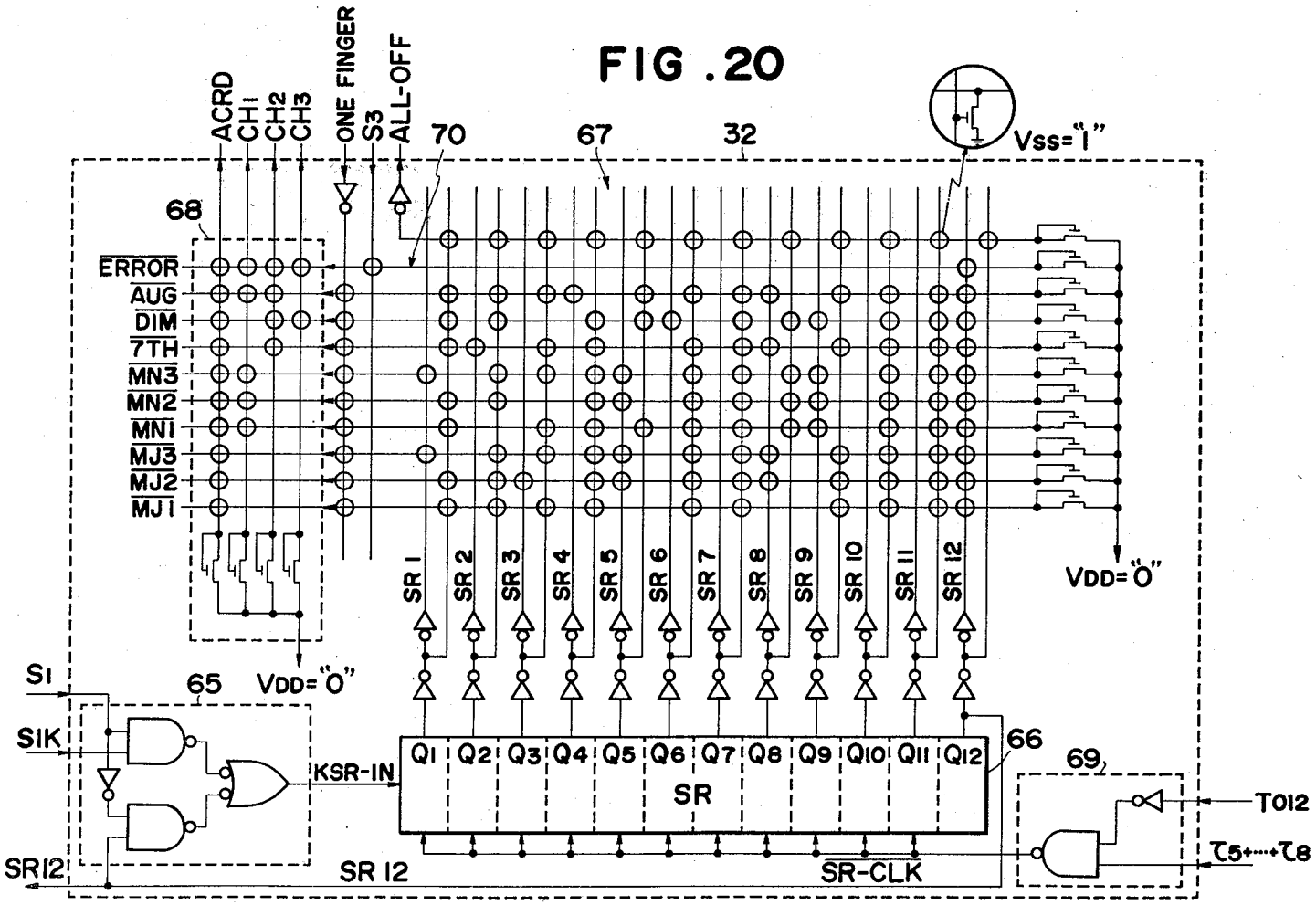
FIG. 20 is a schematic diagram of a chord detector circuit.

Referring to FIG. 20, the chord detector 32 has a shift/write switching circuit 65 which receives the output from the timing signal waveshaping circuit 32, a shift register 66 of the serial input/parallel output type, a first ROM (chord ROM) 67 which stores therein basic forms of the chord names (for example, various C chords) to be controlled by the shift register 66, a second ROM 68 for generating the chord coincidence signal ACRD and the binary signal CH1, CH2, CH3 representative of the chord, and a clock correction circuit 69 for the shift register. Now, the operation of the chord detector circuit 32 will be explained. The shift/write switching circuit 65 is made up of a combination of several gate circuits. It is supplied with the sequence signal $S_1$ from the sequence signal generator 54, the signal SIK waveshaped by the timing signal waveshaping circuit 31, and serial outputs of the shift register 66. That, is the shift/write switching circuit 65 for selecting whether the key depression signal of the accompanying keyboard is written into the shift register 66 in the period of the time-division control sequnce $S_1$ or the key depression signal is stored while circularly shifting it in a period other than $S_1$. When the sequence signal $S_1$ is of level "1," the SIK signal is sent into the shift register 66, whereas when the sequence signal $S_1$ is of level "0," the serial outputs of the shift register 66 are again sent into the shift register 66.

Figure 21:
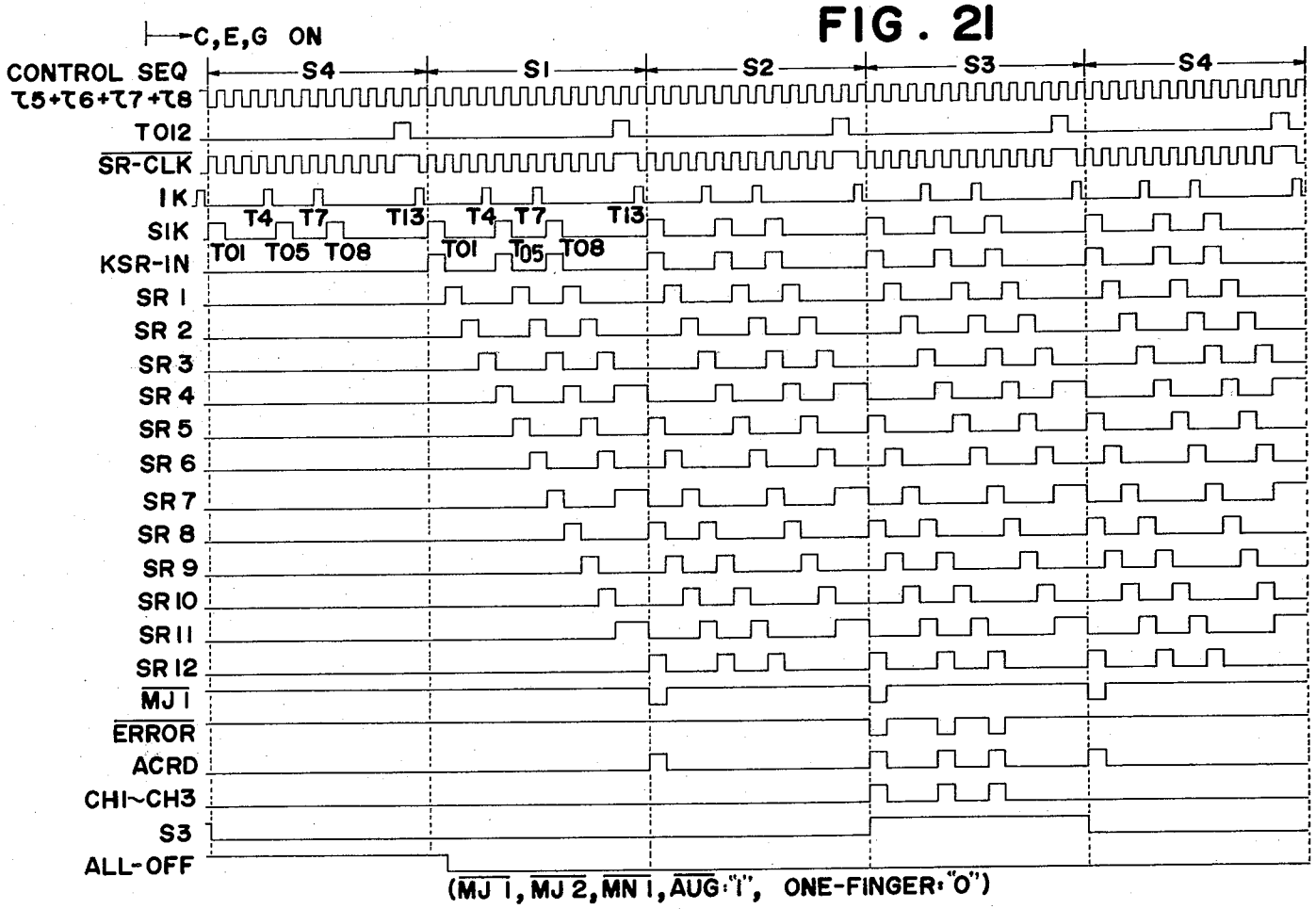
FIG. 21 is an operating timing diagram of the chord detector circuit in the case where keys C, E and G are depressed.

FIG. 21 is an operating timing diagram of the chord detector in the case where keys C, E and G have been actuated. Assuming that the keys C, E and G have been concurrently depressed on the accompanying keyboard and that the C major chord has been assigned, the serial timing signals $I_K$ corresponding to the depressed key notes are applied to the ik terminal, and the signal SIK ($T_{01}$, $T_{05}$, $T_{08}$) waveshaped by the timing signal waveshaping circuit 31 is impressed on the chord detector 32. As stated previously, the SIK signal is applied as the input signal KSR-IN of the shift register 66 only during the period of the control sequence $S_1$ under the action of the shift/write switching circuit 65. The shift register 66 is constructed of 12 bits, its content is sequentially shifted by an output $\overline{\text{SR-CLK}}$ of the clock correction circuit 69, and it delivers output signals SR1, SR2, . . . , and SR12 in parallel. The clock correction circuit 69 brings the shift register 66 into the duodecimal operation by one $T_{012}$ of the timing signals from the decoder 52 for generating the note allotment timing signals and the timing pulse $\tau_5 + \ldots + \tau_8$ from the timing pulse generator 30.

The output signals SR1, . . . , and SR12 of the shift register 66 are entered into the chord ROM 67, and are directly compared with the stored contents thereof. ROM lines at which the comparison results are coincident are activated, and the binary information representative of the type of the corresponding chord is read out from the second ROM 68, the chord coincidence signal ACRD being also generated.

In case where the keys C, E and G have been depressed as stated above, as illustrated in FIG. 12 lateral ROM line $\overline{\text{MJ1}}$ is activated in the period of the time-division control sequence signals $S_2$, $S_3$ and $S_4$ and at the timing $T_{01}$ and a ROM line $\overline{\text{ERROR}}$ is activated in the period of $S_3$ and at the timings of $T_{01}$, $T_{05}$ and $T_{08}$ so as to provide the chord coincidenced signal ACRD and the chord type indicating signal CH1, CH2, CH3 (refer to Table 3-1). That is, in case of the above key depression pattern, the second ROM 68 is read out by the ROM line $\overline{\text{MJ1}}$, and the signal CH1, CH2, CH3 becomes "0", "0", "0".

If the key depression chord is a chord which is not stored in the chord ROM 67, this chord ROM 67 is not activated in the period of the time-division control sequence signal $S_2$, a ROM line 70 for detecting an erroneous key depression is activated in the period of the time-division control sequence signal $S_3$ and at the timing of the key depression tone, and the chord coincidence signal ACRD and a binary information representative of the erroneous chord are provided from the second ROM 68. In the time-division control sequence $S_3$, even in case where any chord stored in the chord ROM 67 has been had its key depressed, the ROM line $\overline{\text{ERROR}}$ is activated. This, however, poses no problem because the next stage is constructed so that the signal CH1, CH2, CH3 indicative of the chord type may be latched by the timing of the chord coincidence signal ACRD issued first.

The chord coincidence signal ACRD generated from the chord detector 32 is entered into the chord/root note write-in pulse generator 33, to generate a chord-/root note write-in pulse ACD-P, by which the chord type and the root note are latched.

The number of the key depression states which are assigned by the player is very large, and depending on what chord detection system is adopted, the degree of the complicacy of the circuit arrangement differs greatly.

Inasmuch as the chord detector 32 has the construction in which the outputs of the shift register 66 are directly supplied for comparisons to the ROMs 67 and 68 storing the binary information indicative of the basic forms of the chord names and the chord types therein, the circuit is simplified. Another advantage is that the chord type and the root note can be detected in one shift cycle of the shift register, so the detection time is shortened to quicken the key response.

VIII. Prevention of Chord Detection unfavorable in Performance

In case where the player actuates a plurality of keys on the accompanying keyboard and assigns chord names, it is sometimes the actual condition that a non-uniformity in the keys occurs at a key release or key depression and that the chord name to be properly assigned is not instituted in a keying period. If a chord corresponding to such a non-uniformity in the keys (erroneous chord in performance) is detected as it is, the automatic accompaniment conforming with the desired chord name will become impossible, which is unfavorable musically.

Figure 22:
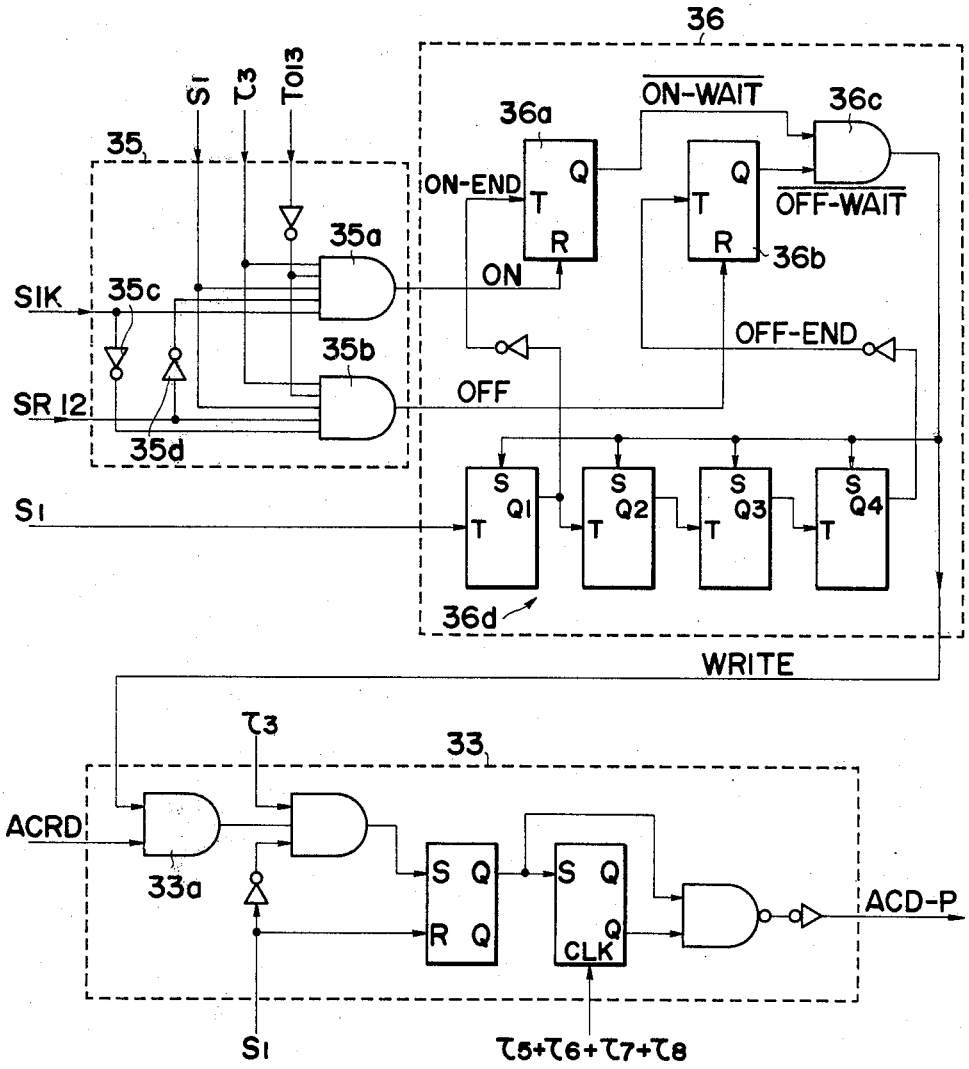
FIG. 22 illustrates a keying detector circuit, an inhibit time generator circuit, and a chord/root note write-in pulse generator circuit.
Figure 23:
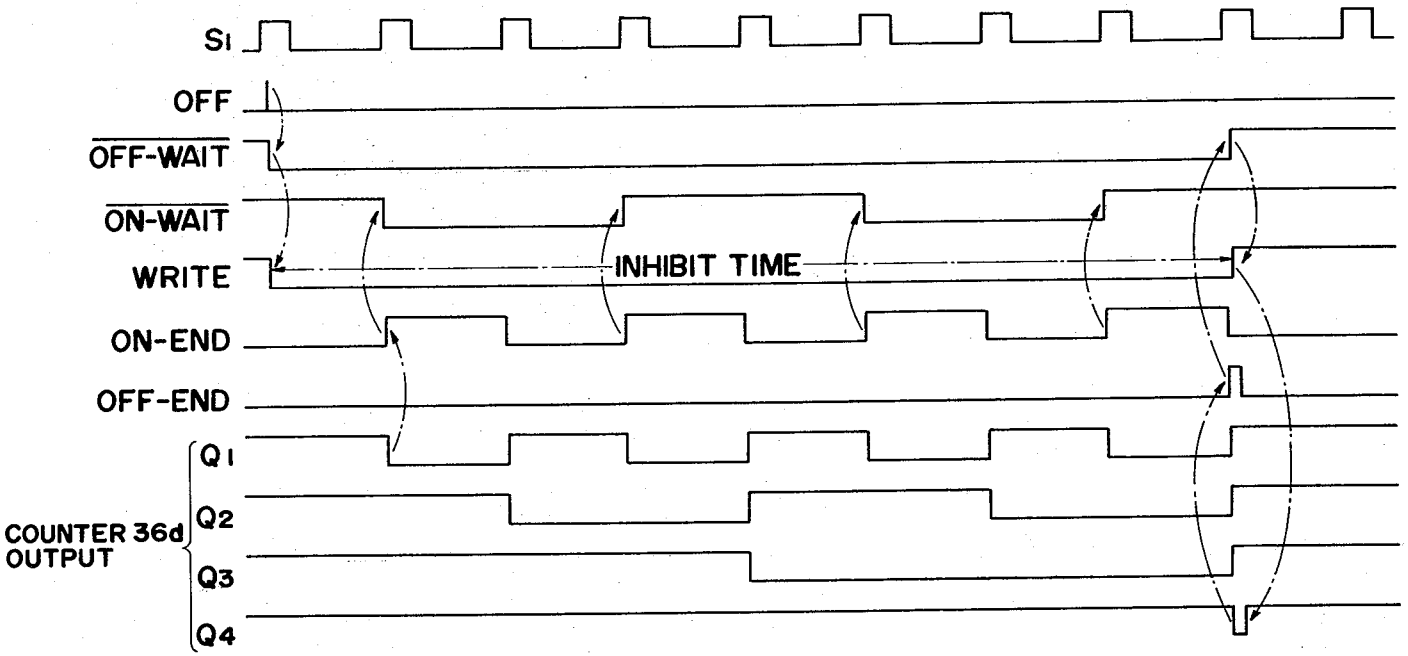
FIG. 23 is a timing diagram which illustrates the operation of the inhibit time generator circuit at the time when a key is released.

Therefore, when the key operation (key depression or key release) of the accompanying keyboard is done, it is detected by the keying detector 35, and the inhibit time generator 36 is controlled by the detection output. Thus, at the key change at which the accompanying key is turned "on" or "off", the operation of the chord/root note write-in pulse generator 33 is ceased for a fixed time so as to prevent the detection of the chord unfavorable for the performance. The keying detector 35, the inhibit time generator 36 and the chord/root note write-in pulse generator 33 are shown in FIG. 22. As apparent from the operating timing diagram (FIG. 21) of the chord detector described before, when the key change takes place, the SIK signal and the SR12 signal become different at the time-division control sequence $S_1$. The key change can accordingly be detected by comparing the SR12 signal and the SIK signal. As illustrated in FIG. 22, in the keying detector 35, the SIK signal and the SR12 signal are respectively entered into AND gates 35*a* and 35*b*, and their inverted outputs owing to inverters 35*c* and 35*d* are also entered into the prespective AND gates 35*b* and 35*a*. The signals $S_1$, $\tau_3$ and $\overline{T_{013}}$ are applied to both the AND gates 35*a* and 35*b*. At the key depression operation, a timing at which the SIK signal becomes "1" and the SR12 signal becomes "0" exists, so that an ON pulse is provided from the AND gate 35*a*. Conversely, at the key release operation, a timing at which the SIK signal becomes "0" and the SR12 signal becomes "1" exists, so that an OFF pulse is provided from the AND gate 35*b*. In the absence of the key change, the outputs of both the AND gates 35*a* and 35*b* holds the "0" state. Such outputs are respectively sent to reset terminals of flip-flops 36*a* and 36*b* of the inhibit time generator 36. Outputs from these flip-flops are entered into an AND gate 36*c*, to form a WRITE signal. On the other hand, the sequence signal $S_1$ is sent to a counter circuit 36*d*, a $Q_1$ output and a $Q_4$ output of which are respectively supplied to the flip-flops 36*a* and 36*b* through inverters. The counter circuit 36*d* is set by the WRITE signal. That is to say, in this embodiment, the WRITE signal is made "0" during one (1) period of the sequence signal $S_1$ at the key depression operation, and over eight (8) periods of the sequence signal $S_1$ at the key release operation. A timing diagram of the inhibit time generator at the time of the key release is given in FIG. 23. The WRITE signal and the chord coincidence signal ACRD from the chord detector 32 are transmitted to a first-stage AND 33*a* of the chord-/root note write-in pulse generator 33. The chord/root note write-in pulse generator 33 is composed of several logic gates and flip-flops. It generates the chord/root note write-in pulse ACD-P by giving a preference to the chord coincidence signal ACRD which arrives first in a period after the time-division control sequence $S_1$. As illustrated in FIG. 22, the WRITE signal controls the passage of the chord coincidence signal ACRD in the AND gate 33*a*. During the fixed inhibit time following the key change, the WRITE signal becomes "0," the chord/root note write-in pulse is not generated, and the stored contents of the chord memory 37 and the accompanying key note memory 58 are not rewritten. Therefore, the unfavorable chord detection is preventable.

Figure 24:
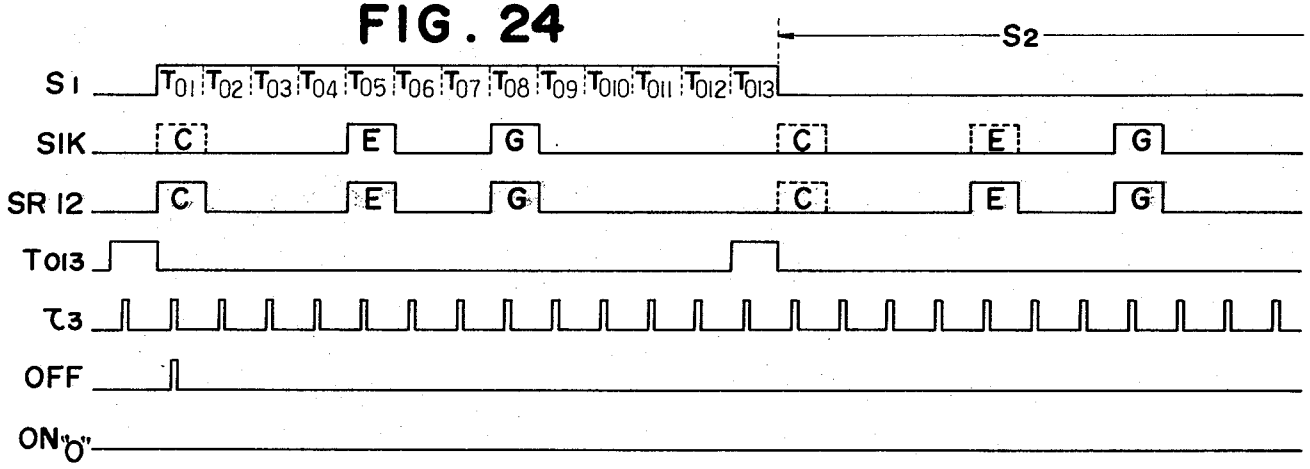
FIG. 24 is a timing diagram of the generation of an OFF signal at the key releasing operation.
Figure 25:
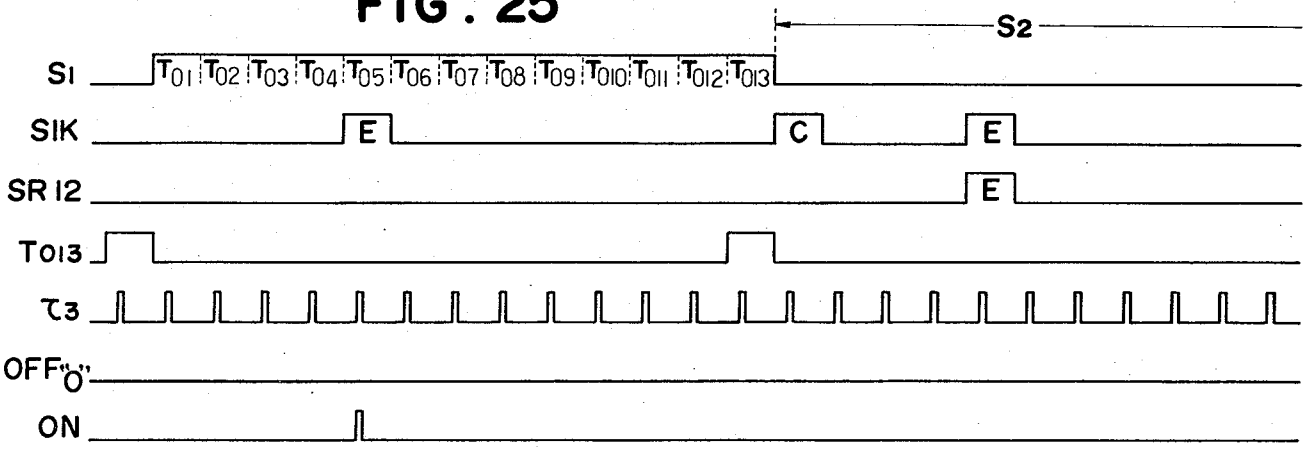
FIG. 25 is a timing diagram of the generation of an ON signal at the key depressing operation.

By way of example, let it be supposed that as illustrated in FIG. 24, the key release operations have been done on the accompanying keyboard from a C, E, G (C major chord)-keys depression state to an E, G-keys depression state, a G-key depression state and an all-keys "off" state with some time differences. Then, an OFF pulse arises at the $\tau_3$ timing of $T_{01}$ of the time-division control sequence $S_1$, whereby the WRITE signal becomes "0" for the fixed period. If the OFF signal does not exist, the E minor chord of notes E and G will be detected in the time-division control sequence $S_2$. It is now supposed that when contrariwise keys C, E and G are depressed on the accompanying keyboard so as to assign the C major chord, the key depression operations have been done in the order of E→C and E→C, E, G. Then, as illustrated in FIG. 25, an ON pulse arises at the $\tau_3$ timing of $T_{05}$ of the time-division control sequence $S_1$, whereby the WRITE signal becomes "0" for the fixed period. If the ON signal does not exist, the E minor chord will be detected in the time-division control sequence $S_2$. By establishing the fixed inhibit time in this manner, even when the non-uniformity in the keys is involved at the key depression or key release operation, only the desired root note/chord is detected, and a smooth performance can be achieved.

IX. Transmission of Degree Signal in Automatic Bass Accompaniment

In the automatic accompanying equipment wherein the player assigns a chord name (such as C major and D minor) on the accompanying keyboard and wherein while executing a chord performance by a chord tone conforming with the assignment, an automatic bass accompaniment corresponding to the chord name is carried out, a root note determined by the assigned chord name is subjected to a scale correction by a degree assignment signal, whereupon the automatic bass accompaniment is carried out.

Usually, the scale correction is made in such a way that the root note signal is caused to correspond to a binary signal and that the binary signal and a binary signal corresponding to the degree assignment signal are added. If necessary, the added result is subjected to an octave correction. A tone corresponding to the corrected result is provided as an output. Then, the bass accompaniment output is obtainable. There are thirteen degree assignments including assignments from 1° to 8°, and they can be denoted by 4-bit binary signals.

Figure 26:
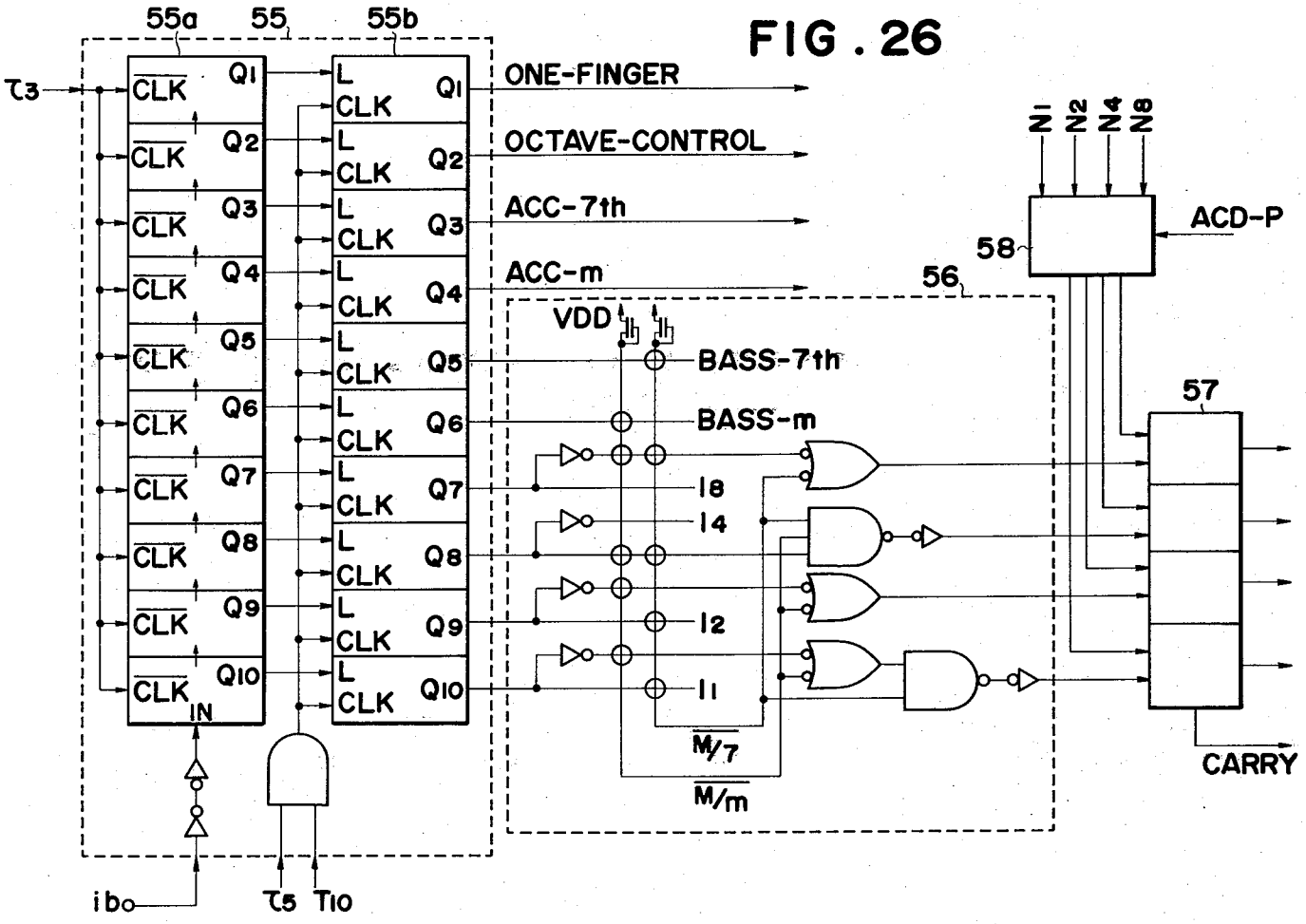
FIG. 26 is a schematic diagram which shows a demultiplexer and a BASS-m, 7th control circuit.

The degree signal and various control signals are entered into the ib terminal of the automatic accompanying circuit 1 as serial time-division signals. Such serial time-division signals are formed by the multiplexer 11. The demultiplexer 55 and the BASS-m and BASS-7th control circuit 56 are shown in FIG. 26. The demultiplexer 55 comprises a serial input/parallel output type shift register 55*a*, and a 10-bit latch circuit 55*b* which receive the parallel outputs of the shift register 55*a*. The serial time-division signals entered into the terminal ib have their timings allotted as indicated in Table 8.

TABLE 8

| Timing | Signal |
|---|---|
| $T_1$ | ONE-FINGER control signal |
| $T_2$ | OCTAVE-CONTROL signal |
| $T_3$ | ACC-7th switching signal |
| $T_4$ | ACC-m switching signal |
| $T_5$ | BASS-7th switching signal |
| $T_6$ | BASS-m switching signal |
| $T_7$ | Degree signal $I_8$ |
| $T_8$ | Degree signal $I_4$ |
| $T_9$ | Degree signal $I_2$ |
| $T_{10}$ | Degree signal $I_1$ |

Figure 27:
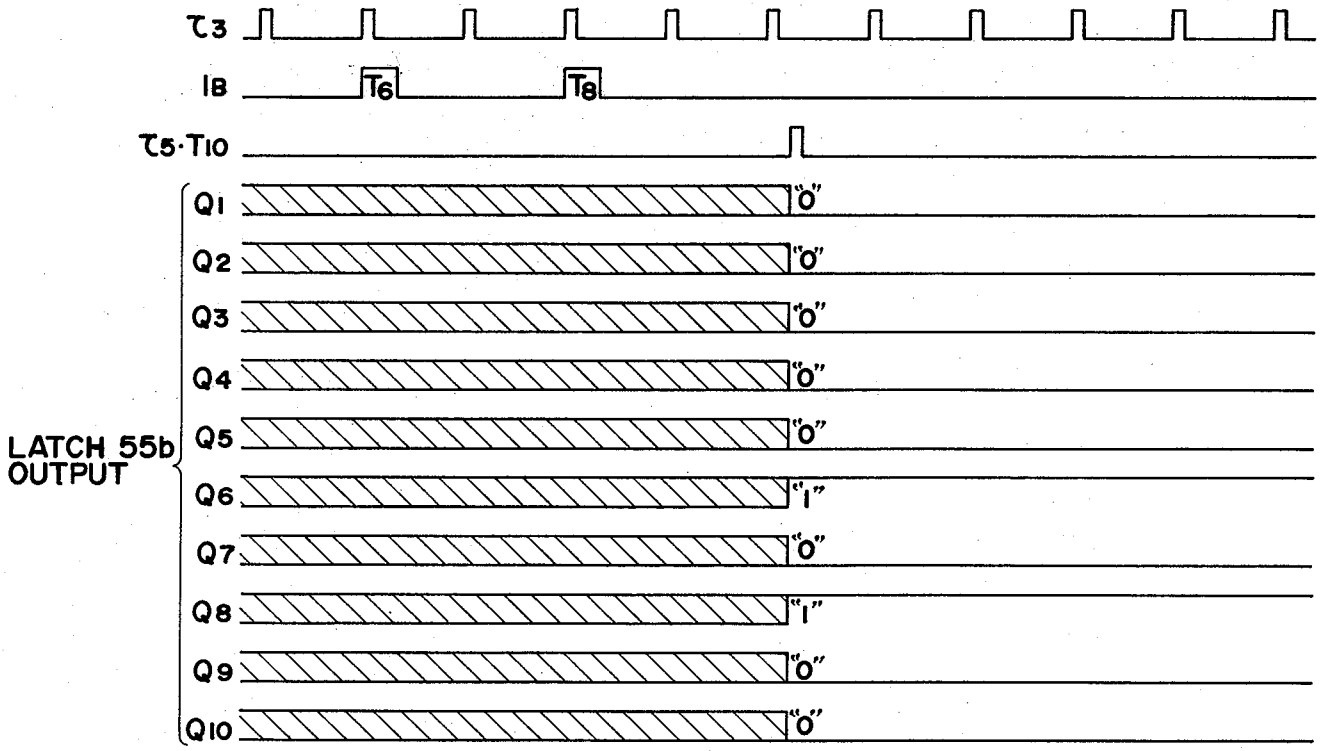
FIG. 27 is an operating timing diagram of the demultiplexer.

Such serial signals are entered from the terminal ib into the shift register 55*a*. They are sequentially shifted by the $\tau_3$ pulses sent to CLK terminals of respective cells of the shift register 55*a*, and produce the parallel outputs. The parallel outputs are supplied to the latch circuit 55*b*, and are latched by the timing signals $\tau_5$ and $T_{10}$. Assuming by way of example that as illustrated in FIG. 27, the BASS-m switching signal and the major third signal ($I_1$:0, $I_2$:0, $I_4$:1, $I_8$:0) have been sent, only a $Q_6$ output and a $Q_8$ output become "1" and all the other outputs become "0" because the parallel outputs are sequentially shifted by the $\tau_3$ pulses and are latched by the timing signal product $\tau_5 \cdot T_{10}$. Among the various signals converted into the parallel d.c. signals by the demultiplexor 55, the 4-bit binary degree signal $I_8$, $I_4$, $I_2$, $I_1$, the BASS-m switching signal and the BASS-7th switching signal are supplied to the BASS-m, 7th control circuit 56. The BASS-m, 7th control circuit 56 is composed of a combination between a ROM (read only memory) portion and many logic gates. If, at reception of the degree signal indicative of major third by the control circuit 56, the BASS-m switching signal exists concurrently, the major third signal is converted into the minor third signal ($I_1$;1, $I_2$:1, $I_4$:0, $I_8$:0). If, at reception of the degree signal indicative of perfect fifth ($I_1$:1, $I_2$:1, $I_4$:1, $I_8$:0), the BASS-7th switching signal exists concurrently, the perfect fifth signal is converted into the minor seventh signal ($I_1$:0, $I_2$:1, $I_4$:0, $I_8$:1). In any other case, the input signal is delivered as it is. Such a 4-bit binary degree signal is supplied to the adder 57, and it is added to the 4-bit binary root note signal transmitted from the accompanying key note memory 58, to be subjected to the scale correction. Here, the accompanying key note memory 58 consists of four latch circuits. The note signal $N_1$, $N_2$, $N_4$, $N_8$ of 4 bits entering from the note signal generator 51 into the respective latch circuits is latched by the timing of the ACD-P signal prepared by the chord/root note write-in pulse generator 33. Thus, the memory 58 stores the root note.

The embodiment is so constructed that the degree assignment signals are converted into the serial time-division signals and transmitted to the scale correction circuit through a signal control line. Therefore, the number of control lines is reduced and one control line suffices between two of the circuits, the number of pins of an IC can be sharply decreased and the cost of the IC can be lowered, and the fabrication in the form of the IC becomes very easy. Since one input signal line from the keyboard portion to the electronic circuit block suffices for each sort of keyboard, especially an electronic musical instrument which is provided with a plurality of sorts of keyboards and which has various automatic accompanying functions can have the number of input terminals of the electronic circuit block reduced sharply and becomes very suitable for the form of a large-scale integrated circuit (LSI).

Although the present invention has been described with reference to the preferred embodiments thereof it is to be understood that the invention is not limited to the specific embodiments but that many alterations and modifications may be made within the spirit of the present invention.

What is claimed is:

1. A keyboard type electronic musical instrument including a keyboard comprising a plurality of keys and corresponding key switches, said instrument comprising:

note signal generator means for generating binary information corresponding to respective notes of a keyboard sequentially and cyclically by utilizing timing pulses of a fixed frequency, converter circuit means for sequentially decoding said binary information to form parallel signals of respectively different timings and for supplying the timing signals to respectively corresponding said key switches of said keyboard, key switch circuit means for actuating, upon depression of at least one key of said keyboard, corresponding said key switch of said at least one depressed key so as to deliver said supplied timing signal, OR circuit means for OR-processing all the timing signals obtained from said key switch circuit means into a key depression signal of time-divided serial timing defining one of a note and chord and for transmitting said key depression signal by one signal line of said keyboard, note/chord detection and storage means for detecting the one of said note and chord assigned by the key depression signal of time-divided serial timing, tone signal production means for producing a tone signal in correspondence to the detected one of said note and chord assigned by the key depression signal of time-divided serial timing, and output means for amplifying said tone signal and driving a loudspeaker, whereby to produce the detected one of said note and chord defined by said key depression signal of time-divided serial timing;

wherein said instrument further comprises waveshaping circuit means for strobing the key depression signals fed from said OR circuit means and for delaying the key depression signal with one timing, thereby minimizing an influence due to signal transmission lag between said converter circuit means and said note/chord detection and storage means.

2. The keyboard type electronic musical instrument according to claim 1, in which said note signal generator means comprises a counter of a divide-by-13 operational mode.

3. The keyboard type electronic musical instrument according to claim 1, in which said converter circuit means comprises a decoder and a gate circuit.

4. The keyboard type electronic musical instrument according to claim 3, in which said decoder comprises a read-only-memory circuit producing 13 parallel signals of different timing which are read out by the binary information from said note signal generator means.

5. The keyboard type electronic musical instrument according to claim 4, in which said 13 parallel signals are narrowed by said gate circuit.

6. The keyboard type electronic musical instrument according to claim 1, wherein said instrument further comprises an additional keyboard having a plurality of key switches to which additional timing signals are supplied by said converter circuit means, additional key switch circuit means for actuating, upon depression of at least one key of said additional keyboard, corresponding said key switch of said at least one depressed key so as to deliver said additional timing signal supplied by said converter circuit means, and OR circuit means for summing all said additional timing signals into an additional key depression signal of time-divided serial timing, wherein the parallel signals formed by said converter circuit means are delivered in parallel to the switch circuit means of each of the keyboards and transmitted by the OR circuit means as a serial timing signal through a single line for each keyboard, said note/chord detection and storage means including latch circuit means for latching the binary information from said note signal generator means in accordance with a predetermined timing of a detected note or a root note of a detected chord to thereby detect and store the note.

7. The keyboard type electronic musical instrument according to claim 6, wherein said note/chord detection and storage means detects a chord assigned by a serial timing key depression signal and delivers an output of binary information corresponding to the chord, and wherein said note/chord detection and storage means detects a timing signal which corresponds to a root note of said chord, and latches said binary information supplied from said note signal generator means to said latch circuit means to thereby detect and store a note of said root note.

8. The keyboard type electronic musical instrument according to claim 6, wherein said note signal generator means, said converter circuit means and said note/chord detection and storage means are integrally formed in LSI.

9. A keyboard type electronic musical instrument including a keyboard comprising a plurality of keys and corresponding key switches, said instrument comprising:

note signal generator means for generating binary information corresponding to respective notes of a keyboard sequentially and cyclically by utilizing timing pulses of a fixed frequency, converter circuit means for sequentially decoding said binary information to form parallel signals of respectively different timings and for supplying the timing signals to respectively corresponding said key switches of said keyboard, key switch circuit means for actuating, upon depression of at least one key of said keyboard, corresponding said key switch of said at least one depressed key so as to deliver said supplied timing signal, OR circuit means for OR-processing all the timing signals obtained from said key switch circuit means into a key depression signal of time-divided serial timing defining one of a note and chord and for transmitting said key depression signal by one signal line of said keyboard, note/chord detection and storage means for detecting the one of said note and chord assigned by the key depression signal of time-divided serial timing, tone signal production means for producing a tone signal in correspondence to the detected one of said note and chord assigned by the key depression signal of time-divided serial timing, and output means for amplifying said tone signal and driving a loudspeaker, whereby to produce the detected one of said note and chord assigned by said key depression signal of time-divided serial timing;

wherein said note signal generator means operates in accordance with a predetermined cyclic rate thereof, and wherein said instrument comprises sequence control signal generator means having a state for changing the state thereof by one cycle in accordance with said predetermined cyclic rate of said note signal generator means, whereby said sequence control signal generator means generates separate sequence signals cyclically.

10. The keyboard type electronic musical instrument according to claim 9, in which said note/chord detection and storage means comprises:

a note detection circuit for detecting a note assigned by the key depression signal; and storage circuit means for detecting and memorizing the state of the keyboard whether same is depressed or released, said storage circuit means being controlled by the sequence signals, the key depression signal being converted into a continuous signal which substantially corresponds to the period of key depression.

11. The keyboard type electronic musical instrument according to claim 10, in which said instrument further comprises a pedal keyboard for accompaniment of bass notes, and said note detection circuit contains a circuit means for detecting an assigned pedal keyboard note and generating an electrical pulse of the pedal keyboard detection.

12. The keyboard type electronic musical instrument according to claim 11, in which said note/chord detection and storage means comprises a pedal keyboard note storage circuit which memorizes a binary information corresponding to a pedal key depression note, whereby when plural pedals of said pedal keyboard are depressed, the note detection electrical pulse is generated in accordance with the timing of either the lowest or highest note of the depressed pedal keyboard by controlling said pedal keyboard note detection circuit by means of the sequence signals, thereby preferentially detecting either the lowest or highest note.

13. The keyboard type electronic musical instrument according to claim 11, wherein said instrument comprises circuit means for generating a bass note signal corresponding to a detected chord, and circuit means for selecting either pedal bass tone or automatic bass tone, whereby depression of the pedal keyboard generates the pedal bass tone and release of the pedal keyboard generates the automatic bass tone.

* * * * *